US006129464A

United States Patent [19]

Nakamura et al.

[11] Patent Number: 6,129,464

[45] Date of Patent: Oct. 10, 2000

[54] PRINTING DEVICE, AND A SYSTEM HAVING THE PRINTING DEVICE AND AN IMAGE PROCESSING DEVICE

[75] Inventors: Isao Nakamura; Ryoji Ebisawa, both of Chiba, Japan

[73] Assignee: Seiko Instruments Inc., Japan

[21] Appl. No.: 09/219,999

[22] Filed: Dec. 23, 1998

[30] Foreign Application Priority Data

| | | | |
|---|---|---|---|
| Dec. 24, 1997 | [JP] | Japan | 9-355542 |
| Dec. 24, 1997 | [JP] | Japan | 9-355544 |
| Sep. 30, 1998 | [JP] | Japan | 10-278098 |

[51] Int. Cl.[7] ..... B41J 21/16

[52] U.S. Cl. ..... 400/279; 400/283

[58] Field of Search ..... 400/279, 283; 347/37

[56] References Cited

U.S. PATENT DOCUMENTS

| | | | |
|---|---|---|---|
| 4,459,050 | 7/1984 | Goldberg et al. | 400/121 |
| 5,368,402 | 11/1994 | Takahashi et al. | 400/279 |
| 5,431,502 | 7/1995 | Orii et al. | 400/279 |
| 5,467,437 | 11/1995 | Fuse | 395/115 |
| 5,575,577 | 11/1996 | Kawakami et al. | 400/705.1 |
| 5,605,407 | 2/1997 | Hama et al. | 400/705.1 |
| 5,620,266 | 4/1997 | Kim | 400/279 |
| 5,686,803 | 11/1997 | Shirotori | 318/567 |
| 5,748,206 | 5/1998 | Yamane | 347/37 |
| 5,894,315 | 4/1999 | Yamane | 347/37 |

*Primary Examiner*—John S. Hilten
*Assistant Examiner*—Charles H. Nolan, Jr.
*Attorney, Agent, or Firm*—Adams & Wilks

[57] ABSTRACT

A printing device comprises a print head for printing an image on a recording medium, a carriage mounted for movement along the recording medium and supporting thereon the print head, an encoder member having division lines, and a sensor supported by the carriage for movement therewith for reading the division lines of the encoder member and outputting pulse signals corresponding to reading of the division lines. A position calculating device calculates a position of the carriage in accordance with the pulse signals from the sensor. An error detection/correction device detects an error in reading the division lines of the encoder member by the sensor and outputs an error correction signal to the position calculating device. The position calculating device calculates a correct position of the carriage in accordance with the error correction signal from the error detection/correction device. The print head prints an image on the recording medium in accordance with an output signal from the position calculating device corresponding to the correct position of the carriage.

36 Claims, 11 Drawing Sheets

PRINTING DEVICE, AND A SYSTEM HAVING THE PRINTING DEVICE AND AN IMAGE PROCESSING DEVICE

BACKGROUND OF THE INVENTION

1. Field of the Invention

This invention relates to a printing device to print an image, and to a system of the printing device and an image processing device.

2. Description of the Related Art

With the conventional printing device, dust may adhere to divisions of a linear encoder, and a sensor held by a carriage may sometimes fail in reading a division of the linear encoder, which causes the carriage position signal to disagree with the image data, and an image reproduced on print paper to develop a fringe.

SUMMARY OF THE INVENTION

This invention has it as its object to provide a printing device in which, even when a sensor misses by accident the reading of a division of a linear encoder, and thereby an error results in the detection of the moving position of a carriage, no image fringing affecting overall images reproduced on print paper will develop, and to provide a system comprising such a printing device and an image processing device.

This invention has as another object to provide a printing device in which, even when a sensor misses by accident the reading of a division of a linear encoder, and thereby an error results in the detection of the moving position of a carriage, the error is instantly corrected, and thus no image fringing affecting overall images reproduced on print paper will develop, and to provide a system comprising such a printing device and an image processing device.

This invention has as a further object to provide a printing device in which, even when the operation becomes unstable at or close to the stroke ends of a carriage, the position detection signal of the carriage remains unaffected, and even when a sensor misses by accident the reading of a division of a linear encoder, the resulting error is checked before the carriage completes one forward and backward movement, so as to prevent such error from accumulating, and thus no image fringing affecting overall images reproduced on print paper will develop and to provide a system comprising such a printing device and an image processing device.

The invention specified herein will provide a printing device comprising a carriage guided by a carriage guide and driven by a motor, a head and a sensor supported by the carriage, an encoder, a running position memorizing device which receives signals informing the reading by the sensor of divisions on the encoder, and memorizes the running position of the carriage, and an error detection/correction circuit which receives signals from the sensor, detects a read error from the encoder, and delivers an error correction signal to the running position memorizing device, wherein the head operates, in response to output from the running position memorizing device, to reproduce an image corresponding to image data on print paper.

The invention specified herein will further provide a printing device wherein the error detection/correction circuit is constructed so constituted as to count clock pulses at each interval between successive sensor signals fed into the running position memorizing section, detects an error in reading of a division on the linear encoder by comparing through calculation the count value with a reference pulse count, and, when an error occurs, delivers a running position correction signal in correspondence with the error.

The invention specified herein will still further provide a printing device wherein the running position memorizing device comprises a counter.

The invention specified herein will still further provide a printing device comprising a carriage guided by a carriage guide and driven into forward and backward movements by a motor, a head and a sensor supported by the carriage, a linear encoder, a running direction determining device to determine the running direction of carriage, a running position memorizing device which receives signals delivered by the running position determining device and signals informing the reading by the sensor of the divisions on the encoder, and memorizes the running position of carriage, and an error detection/correction circuit which receives signals from the sensor, detects a read error therein, and delivers an error correction signal to the running position memorizing device, wherein:

the head operates, in response to an output from the running position memorizing device, to reproduce an image corresponding to image data on print paper.

The invention specified herein will still further provide a printing device wherein the running direction determining device determines the running direction by using pulses different in phase delivered by two sensors.

The invention specified herein will still further provide a printing device wherein the running position memorizing device comprises an up-down (bi-directional) counter which counts up (towards summing) pulses from the sensor while the carriage is making a forward movement, and counts down (towards subtracting) the same pulses while the carriage is making a backward movement.

The invention specified herein will provide a printing device comprising a carriage guided by a carriage guide and driven in forward and backward movements by a motor, a head and a sensor supported by the carriage, a linear encoder, a running direction determining device to determine the running direction of carriage, a running position memorizing device which receives signals informing the reading by the sensor of divisions on the encoder and memorizes the running position of the carriage, and immediately thereafter is preset to a specified position dependent on a signal from the running position determining device., wherein:

both ends of divisions on the encoder are inside the stroke ends of the sensor, and the head operates, in response to an output from the running position memorizing device, to reproduce an image corresponding to image data on print paper.

The invention specified herein will provide a printing device wherein the running direction determining device determines the running direction by using pulses different in phase delivered by two sensors.

The invention specified herein will provide a printing device wherein the running direction memorizing device comprises an up-down (bi-directional) counter which, in response to a signal from the running direction determining device, counts up (towards summing) pulses from the sensor while the carriage is making a forward movement, and counts down (towards subtracting) the same pulses while the carriage is making a backward movement.

The invention specified herein will provide a printing device comprising a head which, while moving in a scan direction, gives signals on print paper according to image data, a linear encoder which is attached to the body of the printing device, and is placed so that a position sensor can generate position pulses dependent on its existence, a position sensor which is carried together with the head, and reads the encoder thereby generating pulses; a running position memorizing device which receives position pulses delivered by the position sensor, and delivers them as head driving synchronous signals, a pulse count correcting circuit which receives position pulses delivered by the position sensor and clock pulses, and counts clock pulses during a detection-for-correction period at which a specific number of position pulses are to be fed; and a correction-by-calculation circuit which receives a count correction pulse from the pulse count correcting circuit, determines by calculation a correction pulse count by referring to the reference pulse count which are to be fed during the detection-for-correction period, and delivers the correction pulse to the running position memorizing device, wherein:

the head generates, in response to head driving synchronous signals, signals corresponding to image data.

The invention specified herein will provide a printing device wherein print paper having a photosensitive type micro-capsule coated thereupon is used, the head has a light emitting element, and light corresponding to image data is radiated by the light emitting element on the print paper thereby producing a latent image thereupon, further comprising a pressurizing means which applies a mechanical pressure on the print paper carrying the latent image, thereby developing the image.

The invention specified herein will provide a system comprising any one of the printing devices described above, and an image processing system in which the image processing device is constructed so as to communicate image data with the printing device.

BRIEF DESCRIPTION OF THE DRAWINGS

For a better understanding of the present invention, reference is made to a detailed description to be read in conjunction with the accompanying drawings, in which:

FIG. 4(*a*) is an enlarged cross-section of a part of the cross-section an depicted in FIG. 2; FIG. 4(*b*) is a cross-section along the line IVb—IVb of FIG. 4(*a*); and FIG. 4(*c*) is a cross-section along the line IVc—IVc of FIG. 4(*a*);

DETAILED DESCRIPTION OF THE PREFERRED EMBODIMENTS

Figure 1:
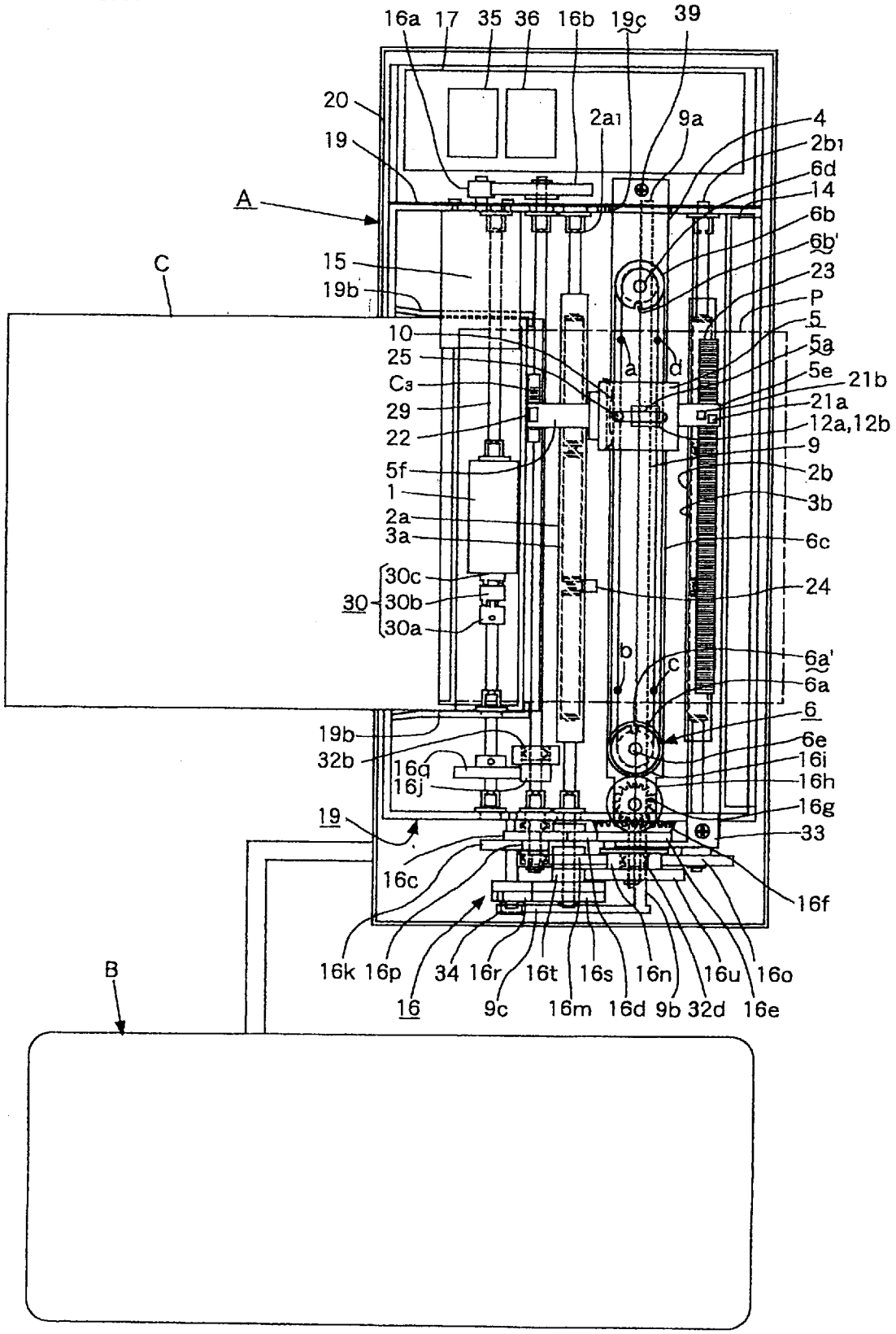
FIG. 1 is a flat view of a system representing a first embodiment of this invention depicted almost as large as the real object, and comprising a printing device and an image processing device.
Figure 2:
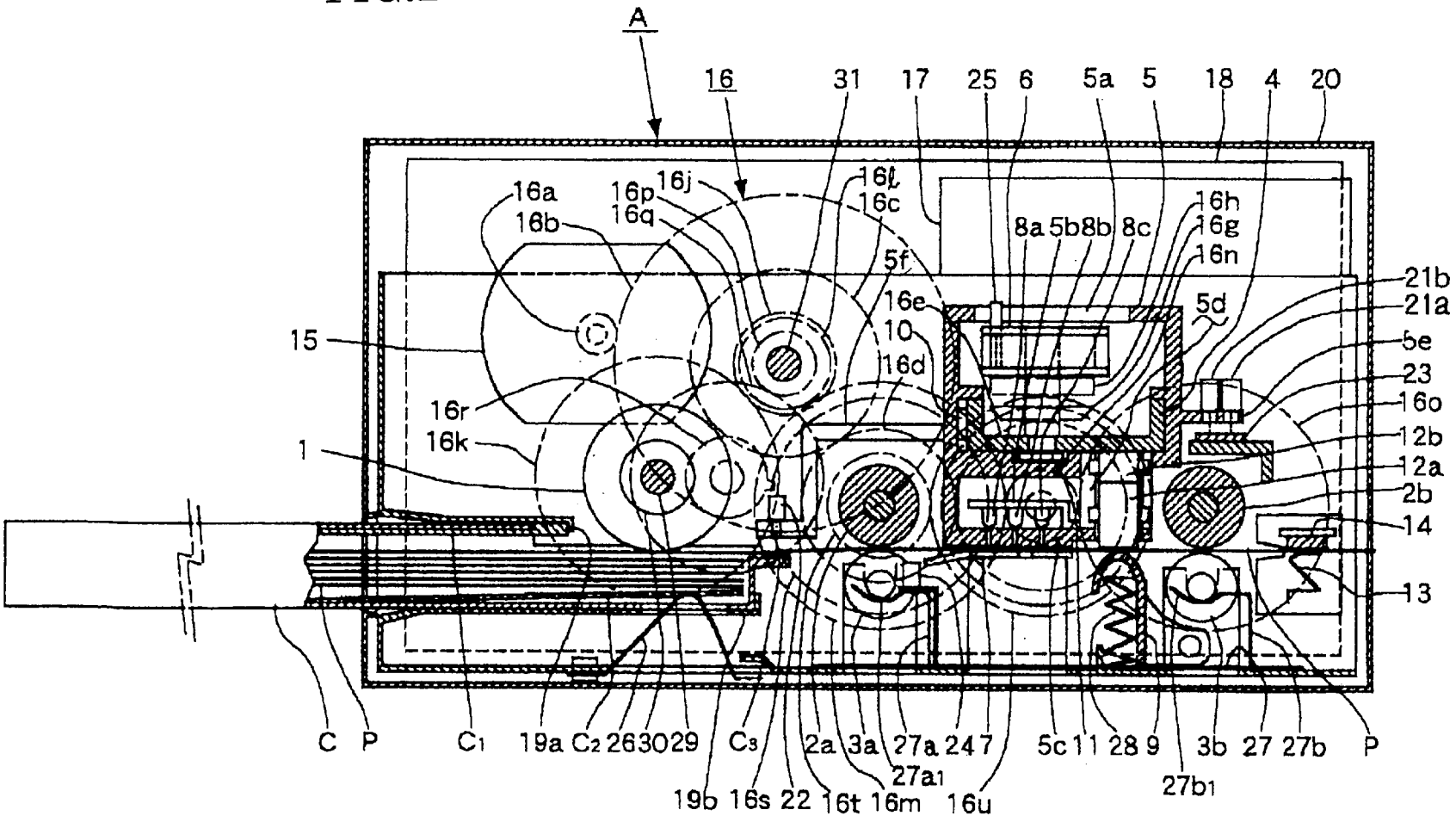
FIG. 2 is an enlarged cross-section of the same printing device with that depicted in FIG. 1, viewed laterally.
Figure 3:
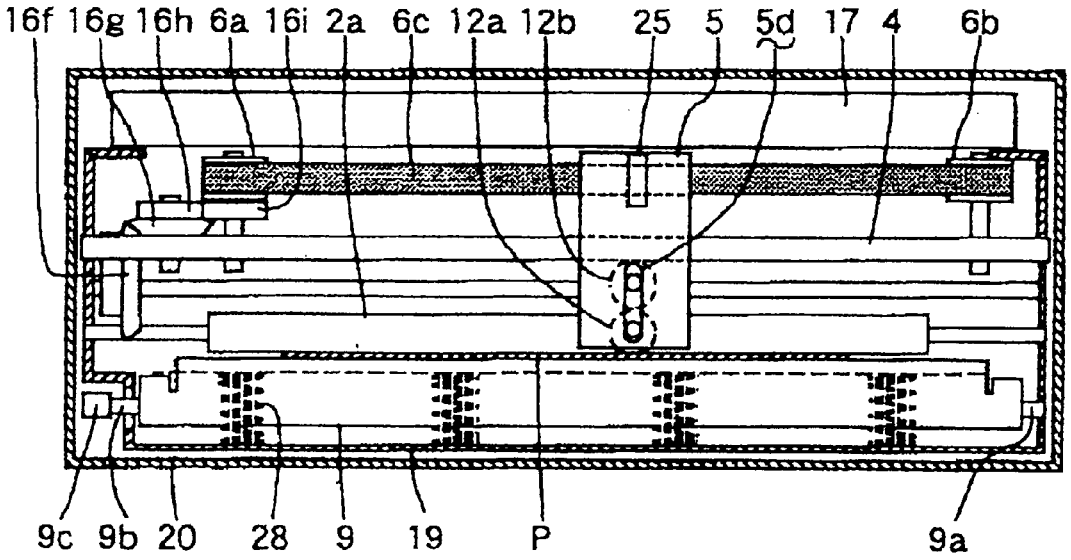
FIG. 3 is a cross-section of the same printing device with that depicted in FIG. 1, viewed from the side towards which print paper is expelled.
Figure 4A:
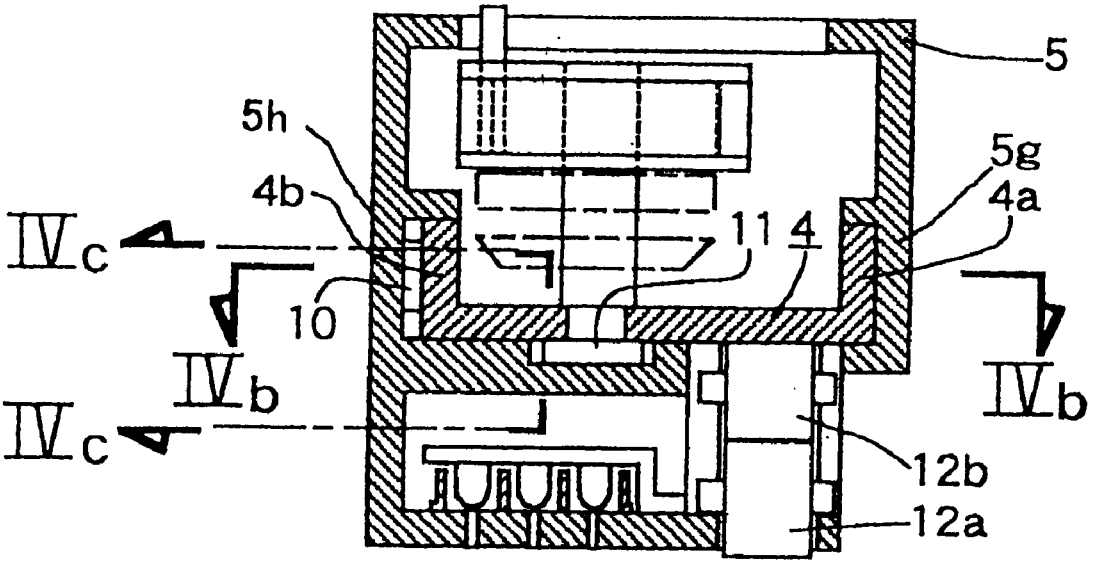
FIG. 4 is a diagram to illustrate the engagement/dependence of the carriage with/on the carriage guide used for the printing device of the first embodiment as depicted in FIG. 1.
Figure 4B:
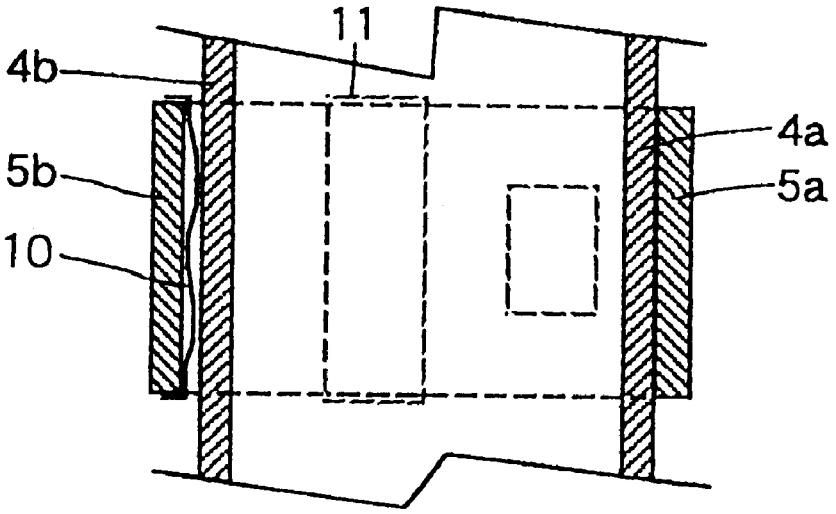
Figure 4C:
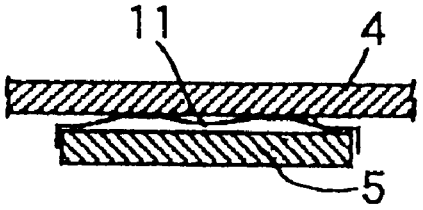
Figure 5:
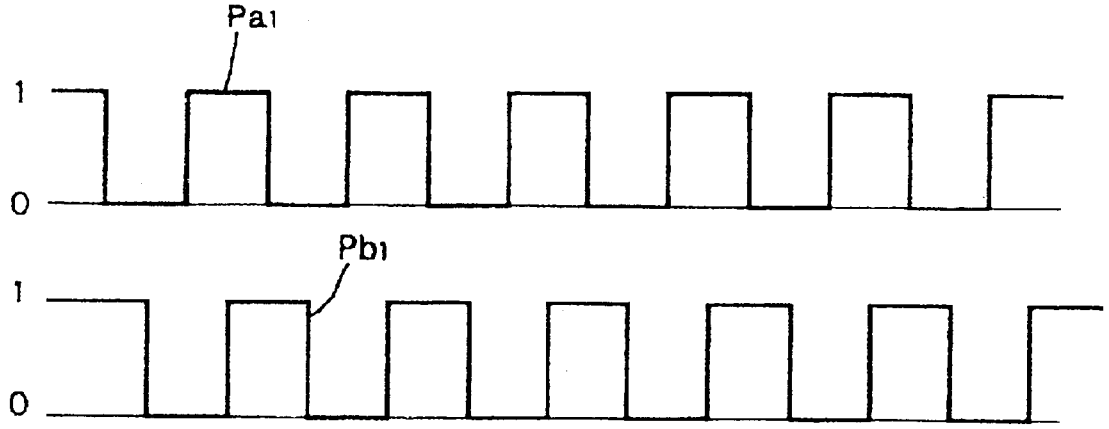
FIG. 5 illustrates signals two sensors deliver when they read divisions on the linear encoder while the carriage is making a forward movement in the embodiment as depicted in FIG. 1.
Figure 6:
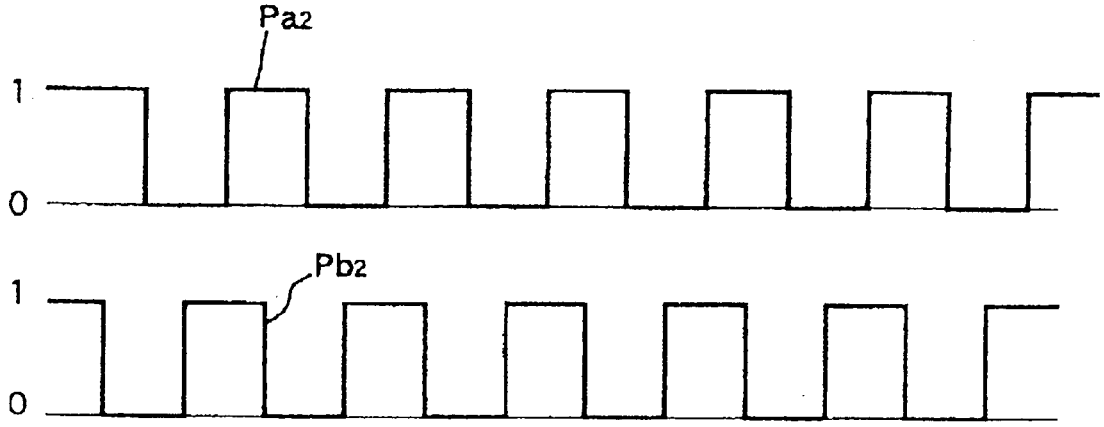
FIG. 6 illustrates signals two sensors deliver when they read divisions on the linear encoder while the carriage is making a backward movement in the embodiment as depicted in FIG. 1.

FIG. 1 gives a flat view of a system comprising a printing device of practically real size, and an image processing device (digital camera, electronic notepad or personal computer). FIG. 2 gives an enlarged sectional view of the printing device viewed laterally. FIG. 3 gives a sectional view of the printing device viewed from the side towards which print paper is expelled. FIGS. 4(*a*)–4(*c*) are enlarged cross-sections of parts of interest which indicate how a carriage engages with a carriage guide in the printing device. FIG. 5 is a perspective view depicting the structure of a bearing to support a pickup roll of the printing device. FIG. 6 is a perspective view illustrating the structure of supporting shafts of pickup roll and of feed roll of the printing device placed against chassis.

As shown in FIG. 1, a printing device A and an image processing device B are constituted such that, when a cable attached to the printing device A is connected to a video output terminal (or digital output terminal) of the image processing device B, a power switch (not illustrated here) of the printing device A is turned on, image data (digital signals) stored in a memory of the image processing device such as a floppy disk are selected, and a switch for printing a selected image (not illustrated here) is turned on, sheets of print paper P stored in a cassette C inserted into the printing device A are fed one after another to have the image printed thereupon.

As shown in FIGS. 1, 2 and 3, the printing device A comprises a pickup roll 1 to push out print paper P from a cassette C, a feed roll 2*a* on the upstream side and a row of three pinch rolls 3*a* and another feed roll 2*b* on the downstream side and another row of three pinch rolls 3*b* to give stepwise advances to the print paper P pushed out by the pickup roll 1, a carriage guide 4 placed crosswise between the feed rolls 2*a* and 2*b*, a carriage 5 to be guided by the carriage guide 4 through engagement, a belt slinging mechanism 6 installed above the carriage guide 4 to bring about a back and force movement of the carriage 5, a carrying table 7 placed on the downstream side of pinch roll 39 to support print paper P horizontally, ten light emitting diodes (LED's) 8*a*, 8*b* and 8*c* mounted to the carriage 5 to form a part of the print head and to radiate blinking rays of light onto print paper P guided onto the carrying table 7, a platen 9 placed between the carrying table 7 and the downstream pinch roller 3*b* so that it receives print paper P from below to gain a linear contact with the latter, two revolving rolls 12*a* and 12*b* mounted to the carriage 5 to press, during the movement of carriage 5, print paper P so as to selectively crush micro-capsules thereupon which have never been exposed to light from LED's 8*a*, 8*b* and 8*c* and thereby escaped hardening, a heater 14 inserted downstream of the downstream feed roll 2*b* to heat the front surface of print paper P pressed by a planar spring 13 to cause the micro-capsules crushed by pressure to release a coloring agent which then contacts with an age receiving layer to rapidly undergo a coloring reaction, a motor 15, a series of gears comprising 20 gears and one-way clutches, and a controller 17 containing a running position memorizing device 35. Symbols 18, 19 and 20 represent a battery, chassis and case, respectively.

The printing device A further comprises sensors 21*a* and 21*b* to act as a position sensor of the print head, and a bar-code sensor 22 in brackets 5*e* and 5*f* of carriage 5, a scale 23 placed opposite to the sensors 21*a* and 21*b* above the heater 14, and a paper sensor to detect the front end of paper P between the upstream pinch rolls 3*a*.

As shown in FIG. 4(*a*), the carriage guide 4 is fabricated in a channel form with a high precision linearity, and ribs 4*a* and 4*b* of its both ends are embraced by channel sections 5*g* and 5*h* formed on both sides of carriage 5. One rib 4*a* of carriage guide 4 contacts with one channel section 5*g*, and their frictional surfaces are covered with an anti-abrasive film made of a substance having a smaller frictional coefficient such as Teflon or a fluorine resin so that the two members can freely move on each other keeping the close contact. On the other hand, the other rib 4*b* of carriage guide 4 has its lateral surface covered with an anti-abrasive film made of a substance having a smaller frictional coefficient such as Teflon or a fluorine resin, and the rib 4*b*, and the other channel section 5*h* of carriage 5 placed opposite thereto have a gap inserted between the two surfaces facing each other.

As shown in FIG. 4(*b*), a stainless-steel planar spring 10 having a bimodal profile is inserted into the gap and contacts with the lateral surface of the carriage 5 in such a way as to permit the free frictional movement of the latter, and thus fluctuations in lateral directions of the carriage 5 are successfully absorbed.

Further, as shown in FIGS. 4(*a*) and 4(*c*), a stainless-steel planar spring 11 attached to the carriage 5 contacts with the under-surface of carriage guide 4 which has been covered with an anti-abrasive film made of a substance having a smaller frictional coefficient such as Teflon or a fluorine resin in such a way as to make a free frictional movement against the latter, and thus fluctuations in up- and downward directions of carriage 5 are successfully absorbed.

Six pinch rolls 3*a* are arranged in two rows each comprising three rolls, and they are supported by six bearings erected on the base of chassis 19 and at the same time they receive an upward force from planar springs 27*a*1 and 27*b*1 placed in series upon the base of chassis 19. The device of this invention, having a structure as described above, requires comparatively less members and only a simple procedure for assembly, and allows a great reduction in production cost.

A series of gears 16 transmit right and reverse rotations of a single motor 15 to movable members as appropriate according to their functions. Particularly through an organic connection of the series of gears with the belt slinging mechanism 6, simple, continuous, counterclockwise rotations of the output axis of motor 15 allow back and forth movements of carriage 5. At the same time they can give a slight advance to print paper P through feed rolls 2*a* and 2*b* each time the carriage 5 makes a turn at either end of its movement. Thus, it is easy to control the operation of motor 15, which in turn makes it possible for the motor to take a ultra-small size to be placed on a hand.

A controller 17 is constructed so as to perform the following initialization operation: on receipt of an on-signal from a power switch of the printing device A, the controller 17 delivers a motor driving signal for driving the motor 15 into clockwise rotations and motor driving signals for driving the motor into counterclockwise rotations; sensors 21*a* and 21*b* attached to the carriage 5 being put into back and forth movements through above signals send signals informing the reading of divisions of a scale 23 to a running position memorizing device 35 to allow the latter to determine by calculation the position of the carriage 5; if the sensor 21 misses reading a division of the scale 23, an error detection/correction circuit 36 sends a running position correction signal to the running position memorizing device 35 to allow the latter to determine by calculation a correct position; when a circulating pin 25 connecting a timing belt 6*c* and the carriage 5 moves to an original point located for example 5 mm inside the lateral edge of print paper P, delivery of a motor driving signal is arrested; and while positioning of the carriage 5 with respect to the original point is taking place, a bar-code sensor 22 receives a signal conveying the reading of a bar-code C3 attached to a cassette C, processes it, and identifies the kind of print paper, and chooses a program from ROM that determines the intensity and duration of light to be emitted by LED's 8*a*, 8*b* and 8*c* forming a head, according to the kind of print paper.

The controller 17 is further constructed so as to perform the following operation: on receipt of an on-signal from an output switch (or a print switch of a printing device) for printing a selected image from an image processing device B, the controller 17, after having made the above initialization operation, receives a position detection signal from the running position memorizing device 35 which has received the data of an image selected through the image processing device B, processes it and converts it by calculation into electric signals capable of blinking LED's 8*a* 8*b* and 8*c*; then the controller 17 delivers a motor driving signal for driving the motor 15 into clockwise rotations; through this movement the pickup roll 1 and feed rolls 2*a* and 2*b* are put into rotation, and the pickup roll 1 pushes out print paper P from the cassette C which is then inserted between the feed roll 2*a* and pinch roll 3*a*; and the controller 17, on receipt of a signal informing the detection of the front end of print paper P, arrests the delivery of the motor driving signal.

The controller 17 is constructed further so as to perform the following operation: immediately after print paper P is pushed out from the cassette C by the pickup roll 1, the controller 17 delivers a motor driving signal to put the motor 15 into counterclockwise rotations, this time to make a printing on print paper P, and simultaneously delivers electric signals corresponding to the data of an image selected by means of an image processing device B to LED's 8*a*, 8*b* and 8*c*. Generation of motor driving signals in this case is based on the count made each time for example the circulating pin passes over an original point, and continues until the rear end of print paper P passes over the downstream feed roll 2*b*. Further, electric signals to cause LED's 8*a*, 8*b* and 8*c* to blink are generated in synchrony with signals delivered by the running position memorizing device 35.

Now, a detailed description will be given with regard the relationships between sensor signals from the sensors 21*a* and 21*b*, signal processing at the running position memorizing device 35 and error detection/correction circuit 36, and electric signals causing LED's 8*a*, 8*b* and 8*c* constituting the head to blink.

A linear encoder has both ends of its scale located 5 mm inside the corresponding crosswise ends of print paper P.

Through this arrangement it is possible for blinking light from LED's 8*a,* 8*b* and 8*c* to fall on print paper P with a margin of 5 mm at each end.

Incidentally, to give an image extending fully across print paper P with no margin, it is necessary that both ends of scale of linear encoder 23 coincide with the corresponding crosswise ends of print paper P, thereby allowing blinking light to fall fully across print paper P, and that pressurization against print paper P by a revolving roll 12*a* revolving over a platen 9 occurs fully across print paper P.

Two sensors 21*a* and 21*b* are placed apart from each other by a distance half as long as the width of a division line on the linear encoder 23. To be concrete, one division of linear encoder is 0.15 mm apart from adjacent ones, and has a width of 0.07 mm, while the sensors 21*a* and 21*b* are so placed as to give an interval of 0.035 mm between them.

Each of the sensors 21*a* and 21*b* incorporates a reflection type photointerrupter; an LED forming an element of each sensor radiates far infra-red rays onto the linear encoder 23 upon which division lines reflect the rays well with, however, blank parts between the former reflecting the rays less; a photo-transistor forming an element of each sensor receives light reflected frog the encoder; an electric current is allowed to flow which has an intensity corresponding with the intensity of light received by the photo-transistor; and thus a change in voltage on the power side of photo-transistor is fed to the running position memorizing device 35 and the error detection/correction circuit 36.

In this embodiment, while the carriage 5 is making a forward movement, the sensor 21*a* is more displaced towards the forward direction than the sensor 21*b*. On the contrary, while the carriage 5 is making a backward movement, the sensor 21*b* is more displaced towards the backward direction than the sensor 21*a*.

Hence, while the carriage 5 is making a forward movement, the signals the sensor 21*a* generates on reading divisions on the linear encoder 23 are as shown by rectangular signals Pa1 of FIG. 5, while the signals the sensor 21*b* generates on reading divisions on the linear encoder 23 are as shown by rectangular signals Pb1.

In the same manner, while the carriage 5 is making a backward movement, the signals sensor 21*a* generates on reading divisions on the linear encoder 23 are as shown by rectangular signals Pa2 of FIG. 6, while the signals the sensor 21*b* generates on reading divisions on the linear encoder 23 are as shown by rectangular signals Pb2. These rectangular signals Pa1, Pb1, Pa2 and Pb2 generated by the sensors 21*a* and 21*b* are position pulses which are brought about depending on the position of head.

Figure 7:
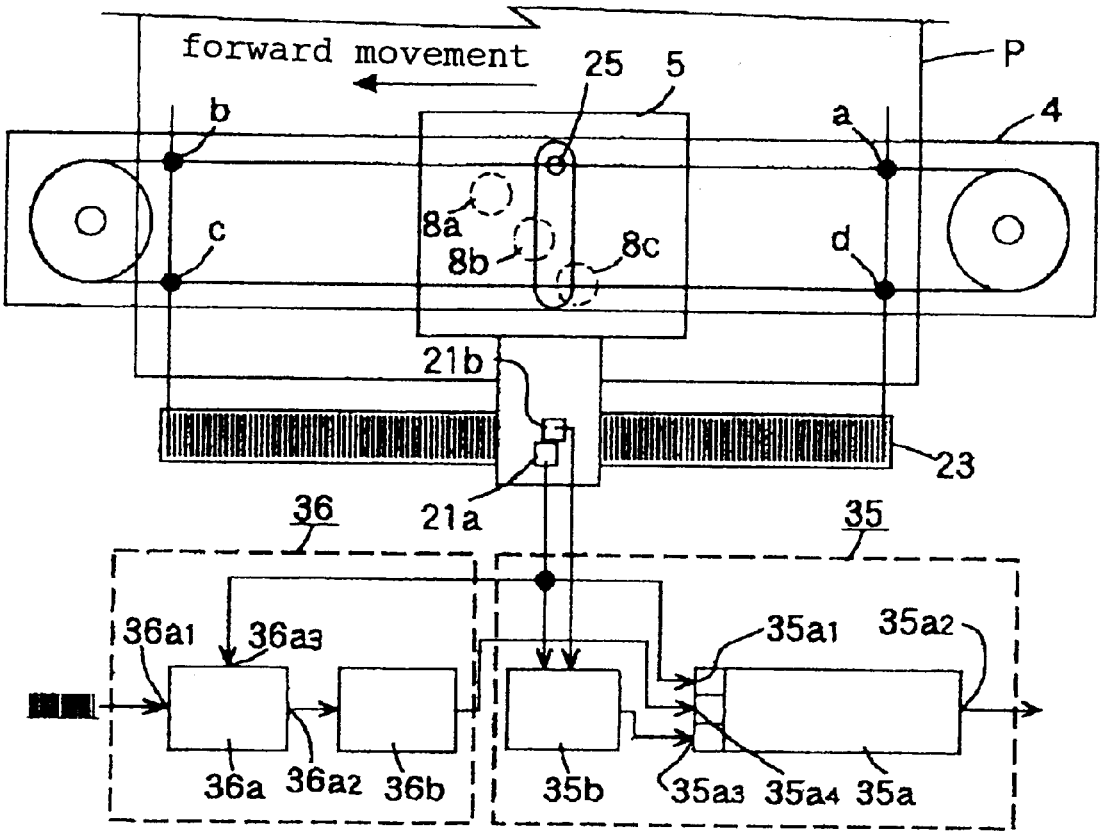
FIG. 7 is a conceptual diagram to illustrate relationships between the carriage, two sensors, linear encoder, running position memorizing device and head of the embodiment as depicted in FIG. 1.

FIG. 7 shows the detail of the running position memorizing device 35 and error detection/correction circuit 36.

The running position memorizing device 35 comprises an up-down counter 35*a,* and receives a signal from a counting direction switching signal generating circuit 35*b* (running direction determining device), while the error detection/correction circuit 36 comprises a pulse counter circuit 36*a* and a correction-by-calculation circuit 36*b*.

The up-down counter circuit 35*a* has an input terminal for count signals 35*a*1 and an output terminal for count signals 35*a*2, an input terminal for count switching signals 35*a*3, and an input terminal for correction signals 35*a*4, and is constructed so as to perform the following operation: sensor signals from the sensor 21*a* are rectified by a wave form rectifying circuit not illustrated here; the thus rectified signals are fed to the input terminal for count signals 35*a*1, so that they can be counted up or down, and at the same time the incoming signals are transmitted intact to the output terminal for count signals 35*a*2 for outward delivery.

The up-down counter circuit 35*a* adjusts its counting condition such as to count up when a signal "1" enters the input terminal for count switching signals 35*a*3, and to count down when a signal "0" enters the same terminal.

The count direction switching signal generating circuit 35*b* is constructed so as to perform the following operation: the circuit receives sensor signals from the two sensors 21*a* and 21*b;* the same circuit judges whether the carriage 5 is making a forward movement by sensing the rectangular signal a remains "0" when the rectangular signal b changes from "1" to "0" as shown in FIG. 5, whereas it judges the carriage 5 is making a backward movement by sensing the rectangular signal a remains "1" when the rectangular signal b changes from "1" to "0" as shown in FIG. 6, and the same circuit delivers a count-up signal (for example, signal conveying "1") while the carriage 5 is making a forward movement, and a count-down signal (for example, signal conveying "0") while the carriage 5 is making a backward movement, to the input terminal 35*a*3 for count switching signals of up-down counter circuit 35*a*.

Sensor signals from the sensors 21*a* and 21*b* may be watched all the time, and a count-up or count-down signal may be delivered each time a change in the signal state occurs. Or alternatively, each time the carriage 5 changes its moving direction from forward to backward or vice versa, the state of rectangular signal a with respect to the state of rectangular signal b is checked once, and a count-up signal or count-down signal may be delivered depending on the comparison result.

The pulse counter circuit 36*a* has an input terminal for count pulses 36*a*1, an output terminal for delivery of count results 36*a*2; and an input terminal for count starting/ending pulses 36*a*3, and is constructed so as to perform the following operation: as soon an the same signal with the sensor signal fed to the input terminal 35*a*1 for count signals of up-down counter circuit 35*a* is entered as a count starting/ending pulse into the input terminal 36*a*3 for count starting/ending pulses, clock signals are allowed to enter the input terminal for count pulses 36*a*1 to be counted; and as soon as the next count starting/ending pulse arrives, a signal representing the counted result up to that time is delivered outside from the output terminal for delivery of count results, and at the same time the circuit in question resets by itself the count value to null, allows clock pulses to reenter, and repeats counting those pulses again.

The correction-by-calculation circuit 36*b* is constructed so as to perform the following operation: the circuit receives a signal corresponding to the count value from the output terminal for count values of pulse counter circuit 36*a* as a numerator (X) of a fraction (X/K); the circuit has been so set as to contain the number of clock pulses delivered during a normal interval between two adjacent count starting/ending pulses as the denominator (K) of the fraction; and each time it receives a signal corresponding to the count value, it calculates a fraction (X/K), rounds off the result to the nearest integer, subtracts unit from that integer, and delivers the thus obtained corrected pulse number to the input terminal for correction signals 35*a*4 of up-down counter circuit 35*a*.

Hence, each time the carriage 5 changes its moving direction from backward to forward, and the sensor 21*b* detects the first division on the linear encoder, and switches the sensor signal from "1" to "0," the sensor signal from the sensor 21*a* becomes "0," and hence the count direction switching signal generating circuit 35*b* switches a count-down signal to a count-up signal to deliver it outside, and then count-up signals continue to appear until the carriage changes its moving direction from forward to backward, and the first two sensor signals are provided.

Further, because sensor signals from the sensor 21*a* are fed to the input terminal for count signals 35*a*1 of up-down counter circuit 35*a* and to the input terminal 36*a*1 of pulse counter circuit 36*a,* the up-down counter counts up pulses and the pulse counter circuit 36*a* receives clock pulses to count them.

When the sensor 21*a* detects the second division on the linear encoder 23, and changes the sensor signal from "1" to "0," this change is transmitted to the input terminal for count signals 35*a*1 of up-down counter circuit 35*a,* and thus the up-down counter circuit 35*a* turns to counting-up operation.

On the other hand, the change in sensor signal which occurs when the sensor 21*a* detects the second division on the linear encoder 23 is also transmitted to the input terminal for count starting/ending pulses 36*a*3, and, hence, the pulse counter circuit 36*a* delivers a signal representing the counted value up to that time from the output terminal for count values 36*a*2, then resets by itself the count value to null, allows reentry of clock pulses and starts to count them. The correction-by-calculation circuit 36*b* receives the signal representing X or the count value from the pulse counter circuit 36*a,* divides it with the constant K, rounds off the result to the nearest integer, then determines a corrected pulse number by subtracting unit from that integer, and sends the number to the input terminal for correction signals 35*a*4 of up-down counter circuit 35*a*. However, unless the sensor misses reading a division on the encoder 23, the corrected pulse number always takes "0," and thus normally the pulse counter sends no output to the input terminal for correction signals 35*a*4.

If the sensor 21*a* misses reading a division on the linear encoder 23, the corrected pulse number takes unit and thus one pulse is delivered to the input terminal for correction signals 35*a*4. If the sensor 21 misses reading two divisions, the corrected pulse number takes two, and thus two pulses are delivered to the input terminal for correction signals 35*a*4. Therefore, the up-down counter circuit 35*a* adds to the counted pulse number an extra number equal to the missed reading, one for one miss and two for two misses, and thus it can deliver from the output terminal for count signals 35*a*2 count signals precisely in synchrony with the position detection signals.

Then, when the sensor 21*a* continues the same operation and detects the third and subsequent divisions on the linear encoder 23, the same operation repeats itself as occurs for the detection of the second division.

In another run, when the carriage 5 changes its moving direction from forward to backward, and the sensor 21*b* detects the first division on the linear encoder 23, and switches the sensor signal from "1" to "0," the sensor signal from the sensor 21*a* becomes "1," and hence the count direction switching signal generating circuit 35*b* switches a count-up signal to a count-down signal to deliver it outside, and then count-down signals continue to appear until the carriage changes its moving direction from backward to forward, and the first two sensor signals are provided.

Then, the up-down counter circuit 35*a* counts down by one unit and the pulse counting circuit 36*a* allows entry of clock pulses and counts them.

When the sensor 21*a* detects the second division on the linear encoder 23, the up-down counter circuit 35*a* counts down by further one unit.

On the other hand, the pulse counter circuit 36*a* allows entry of sensor signals from the sensor 21*a,* delivers a signal X representing the count value up to that time, and then resets by itself the count value to null, allows reentry of clock pulses and count them. The correction-by-calculation circuit 36*b* receives the signal X representing the count value from the pulse counter circuit 36*a,* divides it by the constant K, rounds off the result to the nearest integer, and delivers correction pulses numbering the same with the integer minus unit to the up-down counter circuit 35*a*. However, unless the sensor 21*a* misses a division on the encoder 23, the corrected pulse number always takes "0," and thus normally the pulse counter sends no output to the input terminal for correction signals 35*a*4.

If the sensor 21*a* misses reading a division on the linear encoder 23, the corrected pulse number takes unit and thus one pulse is delivered to the input terminal for correction signals 35*a*4. If the sensor 21 misses reading two divisions, the corrected pulse number takes two, and thus two pulses are delivered to the input terminal for correction signals 35*a*4. Therefore, the up-down counter circuit 35*a* counts down the pulse number more by an extra number equal to the missed reading, and thus it can deliver, from the output terminal for count signals 35*a*2, count signals precisely in synchrony with the position detection signals. Then, when the sensor 21*a* continues the same operation and detects the third and subsequent divisions on the linear encoder 23, the same operation repeats itself as occurs for the detection of the second division.

Although the carriage 5 may pass through an unstable position or undergo a chattering each time it turns, the running position memorizing device 35 allows stable entry of sensor signals from the sensors 21*a* and 21*b,* because both ends of divisions across the linear encoder 23 are located sufficiently well apart from and inside the stroke ends of carriage 5.

The controller 17 is constructed so as to perform the following operation: it receives signals from the output terminal for count signals 35*a*2 of up-down counter circuit 35*a,* converts them by calculation into electric signals which serve as synchronous driving signals to blink LED's 8*a,* 8*b* and 8*c,* and delivers those electric signals for blinking LED's 8*a,* 8*b* and 8*c* to LED's 8*a,* 8*b* and 8*c* constituting the head.

As seen from above, even if the sensors 21*a* and 21*b* miss reading a division on the linear encoder 23, and owing to this miss, an error in the detection of running position of carriage 5 occurs, that error is readily compensated for before the carriage makes one forward and backward movement so that such errors do not accumulate, and thus no fringe of any one image will extend to overall images reproduced on print paper.

This invention will be further detailed below.

The printing device A is constructed so as to perform the following operation: when a cassette case C is inserted into a case through an open slot for cassette entry, a projection attached to a sliding door C1 on the top surface of cassette C hits against a nail 19*a* placed on chassis 19 to open the sliding door C1; a cassette holding section 19*b* placed on the chassis holds the cassette C by engagement; then a triangular flexed planar spring 26 with a profile invades into the bottom of cassette C from an opening prepared thereupon, to raise the base plate C2 of the cassette C and thereby to impart a thrust on print paper P so that the latter makes a close contact with the pickup roll 1.

The cassette C contains a stack of print paper P consisting, for example, of 10 sheets. Print paper P has an image receiving layer coated on its base, micro-capsules each having a diameter of about 4 micron and uniformly coated on the top of the foregoing, and a polyester film further laminated on the top of the foregoing.

Micro-capsules contain, as a mass, a coloring substance which is transparent before developing a color, reacts with the image receiving layer to develop a color, and accelerates the reaction when heated to readily develop a color, and a photo-setting substance which remains transparent before and after the coloring reaction, and hardens when exposed to light with a specific wave length.

When the micro-capsule is crushed by pressure, the coloring substance thereof comes into contact with the image receiving layer, and, when exposed to heat, rapidly develops a color.

With the print paper P used in the invention specified herein, a polyester film is overlaid in advance, and thus it is not necessary to overlay a film after the coloring substance has developed a color as is usually performed for the conventional paper.

Various types of print paper P are usable: one type has one kind of micro-capsules coated thereon, to develop a single color varied in gradation; another type has three kinds of micro-capsules coated thereon to develop a full color comprising 256 hues; and others have a high sensitivity or low sensitivity. Micro-capsules applied onto print paper P to develop a full color contain a coloring substance (transparent before developing a color) to develop either yellow, magenta or cyan, and a photo-setting substance which is sensitive only to light having a wavelength complimentary to the color the coloring substance will develop, and, when exposed to light with that particular wavelength, hardens so that, after hardening, it prevents the encasing capsule from being crushed even in the presence of a high pressure.

The pickup roll 1 is a rubber roll, and is attached freely rotatable to a shaft 29. The pickup roll 1, when the motor 15 makes clockwise turns, is put into rotation such that the rotation of shaft 29 is transmitted by way of a three-piece nail clutch 30 to print paper P to push out the latter.

The three-piece nail clutch 30 consists of a driving nail 30*a* fixed to the supporting shaft 29, an intermediate nail 30*b* with nail parts on both sides and so attached to the shaft 29 as to freely slide along the latter, and a subject nail 30*c* extending from the pickup roll 1. When the cassette C is inserted into the case 1, the pickup roll 1 comes into contact with print paper P which makes a relative movement in the direction of insertion. Through this arrangement, the pickup roll will have an extra margin as long as about one of a half of a rotation in the direction of paper advance, and, when the supporting shaft 29 makes one half turn, the rotation of the shaft 29 supporting the driving nail 30*a,* intermediate nail 30*b* and subject nail 30*c* is transmitted to the pickup roll 1.

Feed rolls 2*a* and 2*b* are obtained after a cylindrical body made of rubber has been wound around a steel-made shaft body and fixed thereto. Pinch rolls 3*a* and 3*b* are made of a plastic alone. Three of pinch rolls 3*a* are placed freely rotatable in a row beneath the upstream feed roll 2*a,* and they are forced by a spring 27*a* to give a pressure on the feed roll 2*a*.

A belt slinging mechanism 6 comprises a driving timing pulley 6*a* and a subject timing pulley 6*b* fixed rotatable to vertical shafts 6*d* and 6*e* erected on the carriage guide 4, and a timing belt 6*c,* and is so constituted as to perform a following operation: a circulating pin 25 attached to the timing belt 6*c* engages with a long slit 5*a* prepared on the carriage 5 which is guided through engagement by the beam-like carriage guide 4, and, when the motor 15 makes counterclockwise rotations, rotation of the motor 15 is transmitted through a series of gears 16 to the driving timing pulley 6*a;* the timing belt 6*c* moves in a counterclockwise direction when viewed flatly from front; and the carriage 5 makes back and forth scanning movements along a direction perpendicular to the direction towards which print paper P is advanced.

When the belt slinging mechanism 6 is driven by the motor 15 for achieving printing, the motor 15 makes continuous rotations, and the carriage 5, being put into back and forth movements via the belt sling mechanism 6, also makes a continuous movement without undergoing any irregularities and interruptions, but inertia which would otherwise develop in the carriage 5 is suppressed by the circulating pin 25 which makes a U turn at each stroke end.

Incidentally, the pulleys 6*a* and 6*b* have concavities 6*a'* and 6*b'* to avoid the interference from the circulating pin 25.

To the carriage guide 4 are snugly fitted the carriage 5, the belt slinging mechanism 6, revolving rolls 12*a* and 12*b,* three sensors 21*a,* 21*b* and 22, and a part of gear series 16. To ensure those snug fits, the carriage guide 4 has its one end close to the driving timing pulley 6*a* inserted into a rectangular hole (having no symbol) prepared on chassis 19 to be fixed there. The carriage guide 4 has its other end close to the subject timing pulley 6*b* inserted into an opening prepared on chassis 19 and fixed there by a screw 39.

The head comprises LED's 8*a,* 8*b* and 8*c* capable of emitting highly bright light, and is fixed to a base plate 5*b* of carriage 5 attached beneath the carriage 5 for fixing the LED's and opposite to the carrying table.

Four LED's 8*a* give light with a wavelength corresponding to red, three LED's 8*b* emit light with a wavelength corresponding to green, and three LED's 8*c* emit light with a wavelength corresponding to blue. LED's 8*a,* 8*b* and 8*c* project their light through a pin-hole prepared on an aperture 5*c* onto print paper P.

LED 8*a* emitting red light harden a photo-setting substance which is enclosed together with a coloring substance to develop a color of cyan in a micro-capsule coated on print paper P. LED 8*b* emitting green light hardens a photo-setting substance which is enclosed together with a coloring substance to develop a color of magenta in a micro-capsule coated on print paper P. LED 8*c* emitting blue light hardens a photo-setting substance which is enclosed together with a coloring substance to develop a color of yellow in a micro-capsule coated on print paper P. Accordingly, an area receiving only a monochromatic light of either R, G or B has a color comprising either Y and M, Y and C, or M and C; an area receiving di-chromatic light has a color comprising either Y, M or C, but its tone, saturation and brightness vary according to the relative intensities of individual light components and the degree of color developing capabilities of individual coloring agents; and an area not exposed to light looks black because three coloring agents giving either Y, M or G have been crushed by pressure.

The controller 17 is constructed so as to make the following calculation: it receives image data from an image processing device B, and processes the image data with due consideration on the phase shift of LED's 8*a,* 8*b* and 8*c*.

The platen 9 and the revolving rolls 12*a* and 12*b* act as a pressuring means by sandwiching a spot of print paper P from back and front, and giving a high pressure thereat and selectively crushing micro-capsules coated thereupon.

The platen 9 extends in a direction perpendicular to the direction towards which print paper P is advanced, and is raised by springs 28 each of which is so adjusted as to give a contact pressure of about 800 g; the part of platen 9 which comes into contact with the revolving roll 12*a* has a cross-section with an elevation in the direction towards which print paper P is advanced, so that it makes a point contact with the revolving roll 12*a;* and its one end 9*a* close to the motor is fixed rotatable in a vertical plane to chassis 19 and a cam follower 9*c* extending from the other end 9*b* of platen far from the motor gives a pressure from down onto a cam 34 which is integratively united with a gear 16*r*.

The cam 34 is constructed so as to perform the following operation: when the revolving roll 12*a* runs over print paper P while applying a pressure to the latter, and approaches either lateral end of print paper P, the cam relieves the pressure exerted on print paper P by the revolving roll 12*a* and platen 9 by pressing down the cam follower 9*c* by a small distance (for example 0.3 mm) at a position, for example, about 5 mm apart from the lateral edge, thereby to avoid the generation of sounds which would be otherwise produced by the revolving roll 12*a* hitting against the platen 9; and when the revolving roll 12*a* makes a U turn, rests again on the lateral edge of print paper P, and passes the point 5 mm apart from the lateral edge, the cam allows the revolving roll 12*a* and cam follower 9*c* to apply pressure onto the print paper P by relieving the cam follower 9*c* from the state of being pressed down The two revolving rolls 12*a* and 12*b* have the axes at both ends engaged with long slits prepared lengthwise on the lateral surfaces of carriage 5.

The revolving roll 12*a,* when print paper P is advanced over the platen 9, makes a forward and backward movement being driven by the carriage 5, and gives a pressure against print paper P.

It is impossible to advance print paper P while the paper is pressed from back and front by the platen 9 and revolving roll 12*a.* To meet this situation, the following operation is made possible: while the circulating pin 25 is making a U turn from a position d to an original position a, or while the circulating pin 25 is making a U turn from a position b to another original position c, the cam 34 presses down the cam follower 9*c* thereby displacing the revolving roll 12*a* to a non-contact position where the revolving roll is kept above the platen with a very tiny gap in between; when the circulating pin 25 reaches the position b or d, the revolving roll 12*a* is at a position 5 mm apart from the upper lateral edge of print paper P, and the non-pressure state sets in, while, when the circulating pin 25 reaches the original position a or c, the revolving roll 12*a* is at a position 5 mm apart from the upper lateral edge of print paper P, and the pressurization state sets in.

Then, the following operation is also made possible: the gear series 16 contains a Genova gear 16*r* which will be described later; the rotation of a gear 16*s* by the Genova gear 16*t* through a single tooth of the latter occurs while the circulating pin 25 makes a U turn from position b to it position c or while the circulating pin 25 makes a U turn from position d to original position a.

Accordingly, while print paper P is relieved of the pressure exerted by the platen 9 and revolving roll 12*a* from back and front, the rotation of motor 15 is transmitted to the pickup roll 1 and feed rolls 2*a* and 2*b,* so that a thrust is given to print paper P to advance the latter.

LED's 8*a,* 8*b* and 8*c,* while the circulating pin 25 is moving from original position a to position b, or from position c to position d, blink in response to electric signals delivered in synchrony with the signals indicating that the sensors 21*a* and 21*b* read divisions on the scale 23.

Then, when the revolving roll 12*a* makes a straight movement, it exerts a pressure like a line drawn upon print paper P, thereby selectively crushing only micro-capsules that have never received light with a specific wavelength to which they are sensitive, and which thus have never undergone hardening; next when the revolving rolls 12*a* and 12*b* reaches one end outside print paper P, receives a discontinuous upward thrust of very minute amount (for example 0.15 mm), makes another straight movement in the opposite direction, and repeats the same operation. Repeating this operation makes it possible to apply a pressure over the-whole surface of print paper P.

The lower and upper revolving rolls 12*a* and 12*b* have the same diameter.

Incidentally, sound absorbing materials (not illustrated here) made of a rubber plate or sponge are applied on the internal surfaces of case 20.

The lower revolving roll 12*a* receives an upward force from the platen which is in turn raised by springs 28, and this upward force is transmitted through the upper revolving roll 12*b* to the carriage guide 4 and sustained by the latter. For this reason, while the carriage 5 is moving, the upper roll 12*b* can revolve on the carriage guide 4 keeping a good contact with the latter, while the lower revolving roll 12*a* can revolve smoothly on the platen 9 without making a slip against the latter.

The heater 14 is so made as to play a following role: print paper P is so advanced by the feed rolls 2*a* and 2*b* as to pass through a gap between the heater 14 and the planar spring 13; and the heater comes into contact with the coloring substance whose micro-capsules have been crushed by pressure and which thus have contacted with the image receiving layer, heats the coloring substance, helps the latter develop a color instantly, and reproduce an image. Incidentally, in this preferred embodiment, the heater 14 is placed on the downstream side of downstream feed roll 2*b,* but preferably the heater should be placed on the upstream side of lower feed roll 2*b* because, if print paper P is kept too long between the heater 14 and the planar spring 13 by accident, overheating would result.

Finally, the composition of gear series 16 will be detailed below in relation to their operations.

Figure 8:
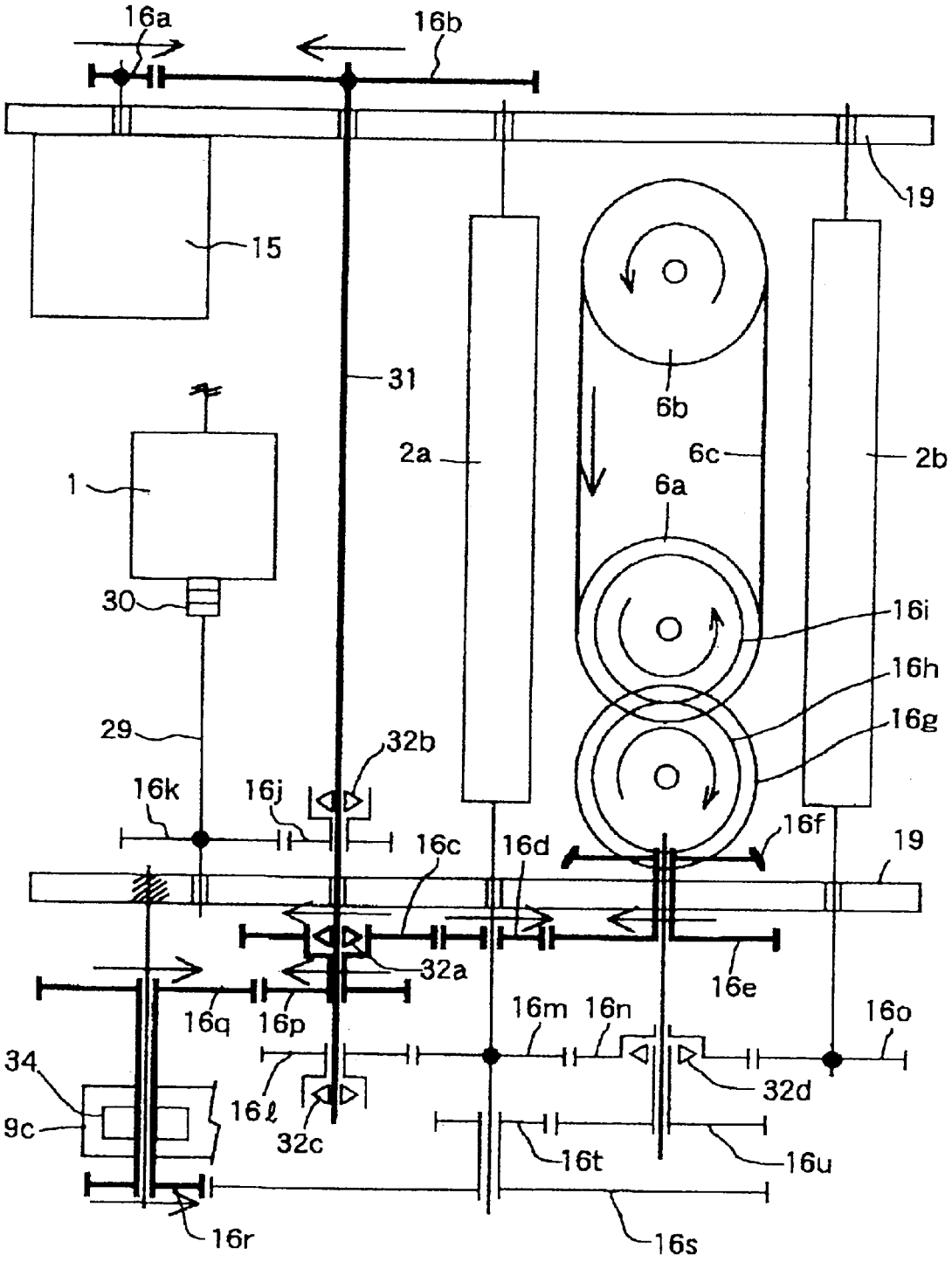
FIG. 8 is a conceptual diagram to illustrate the first driving force transmitting route of gear series employed by the embodiment as depicted in FIG. 1.

(I) First Driving Force Transmitting Route (FIG. 8)

Firstly, when an on-signal is fed to a power switch of printing device A, the motor 15 is turned one round counterclockwise, and the carriage 5 makes one forward and backward movement.

During this movement, the gear series 16 transmits the rotation of motor 15 through the engagement of gear 16*a* (teeth number 12) with gear 16*b* (teeth number 84) to a shaft 31; the rotation of gear 31 is transmitted via a one-way clutch 32*a* to a gear 16*c* (teeth number 30); the rotation is further transmitted via a gear 16*c,* gear 16*d* (teeth number 20) and gear 16*e* (teeth number 30) meshing with each other to a bevel gear 16 (teeth number 30) united with a gear 16*e;* the rotation is further transmitted via a bevel gear 16*f* and bevel gear 16*g* (teeth number 15) engaging with each other to a bevel gear 16*h* (teeth number 15) united with a bevel gear 16*g;* and the rotation is further transmitted to a gear 16*h* and gear 16*i* (teeth number 15). Because the gear 16I is integratively united with the driving timing pulley 6*a* of the belt slinging mechanism 6, the belt slinging mechanism sets in running to put the carriage 5 into back and forth movements.

Incidentally, the gear series 16 is so constituted as to perform a following operation: each time the carriage 5 makes a forward and backward movement, the rotation of motor 15 transmitted to the feed rolls 2*a* and 2*b* is greatly decelerated twice, that is, when the circulating pin 25 makes a U turn from position b to c, and from position d to original position a, so that, during those intervals, a rotation with a very tiny angle is given to the feed rolls 2*a* and 2*b* which then give a slight advance of 0.15 mm to print paper P. The advance is negligible because it occurs only once for each forward and backward movement of carriage 5.

The driving force transmitting route through which the rotation of motor 15 is transmitted to the pickup roll 1 and to the feed rolls 2*a* and 2*b* while the circulating pin 25 is making a U turn from position b to c or position d to original position a will be described in section (III) below.

Figure 9:
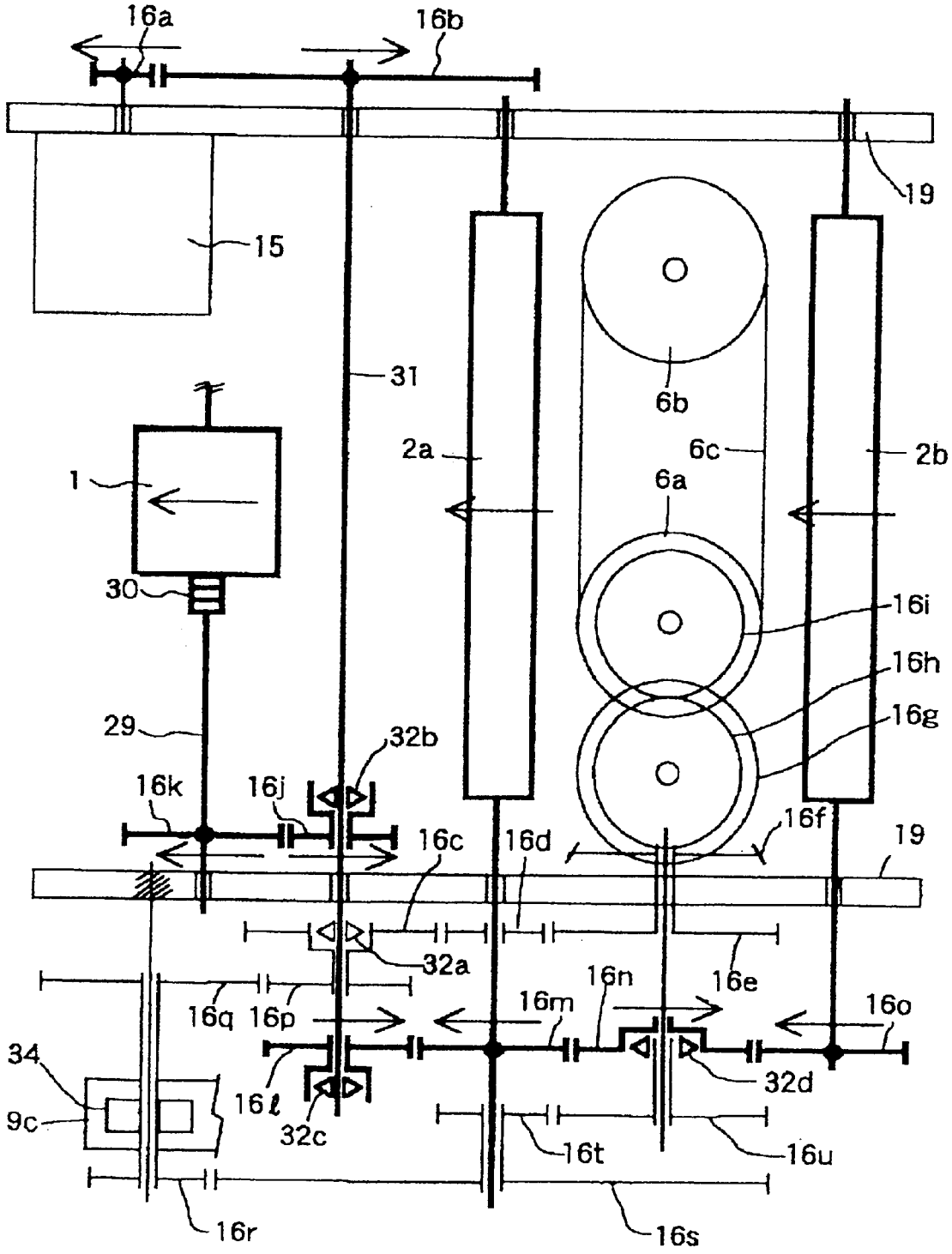
FIG. 9 is a conceptual diagram to illustrate the second driving force transmitting route of gear series employed by the embodiment as depicted in FIG. 1.

(II) Second Driving Force Transmitting Route (FIG. 9)

Next, when a switch for printing out a selected image from the image processing device B is turned on, the motor 15 starts to make clockwise rotations, and the pickup roll 1 and feed rolls 2*a* and 2*b* are put into rotation.

To attain this, the gear series 16 makes a following operation: the rotation of motor 15 is transmitted via a gear 16*e* and gear 16*b* meshing with each other to a shaft 31; the rotation of shaft 31 is transmitted via a one-way clutch 32*b* to a gear 16*j* (teeth number 12); the rotation is further transmitted via a gear 16*j* and gear 16*k* (teeth number 42) meshing with each other to a supporting axis 29 of the pickup roll 1; the rotation of axis 31 is also transmitted via a one-way clutch to a gear 16I (teeth number 19); and the rotation is further transmitted via a gear 16I, gear 16*m* (teeth number 31), gear 16*n* (teeth number 19) and gear (teeth number 31) meshing with each other to feed rolls 2*a* and 2*b* integratively united with a gear 16*m* or 16*o*.

Incidentally, when the controller 17 receives an instruction to rapidly advance print paper P, it delivers driving signals to drive the motor 15 so that this second mode operation continues until exclusion of print paper is completed.

Figure 10:
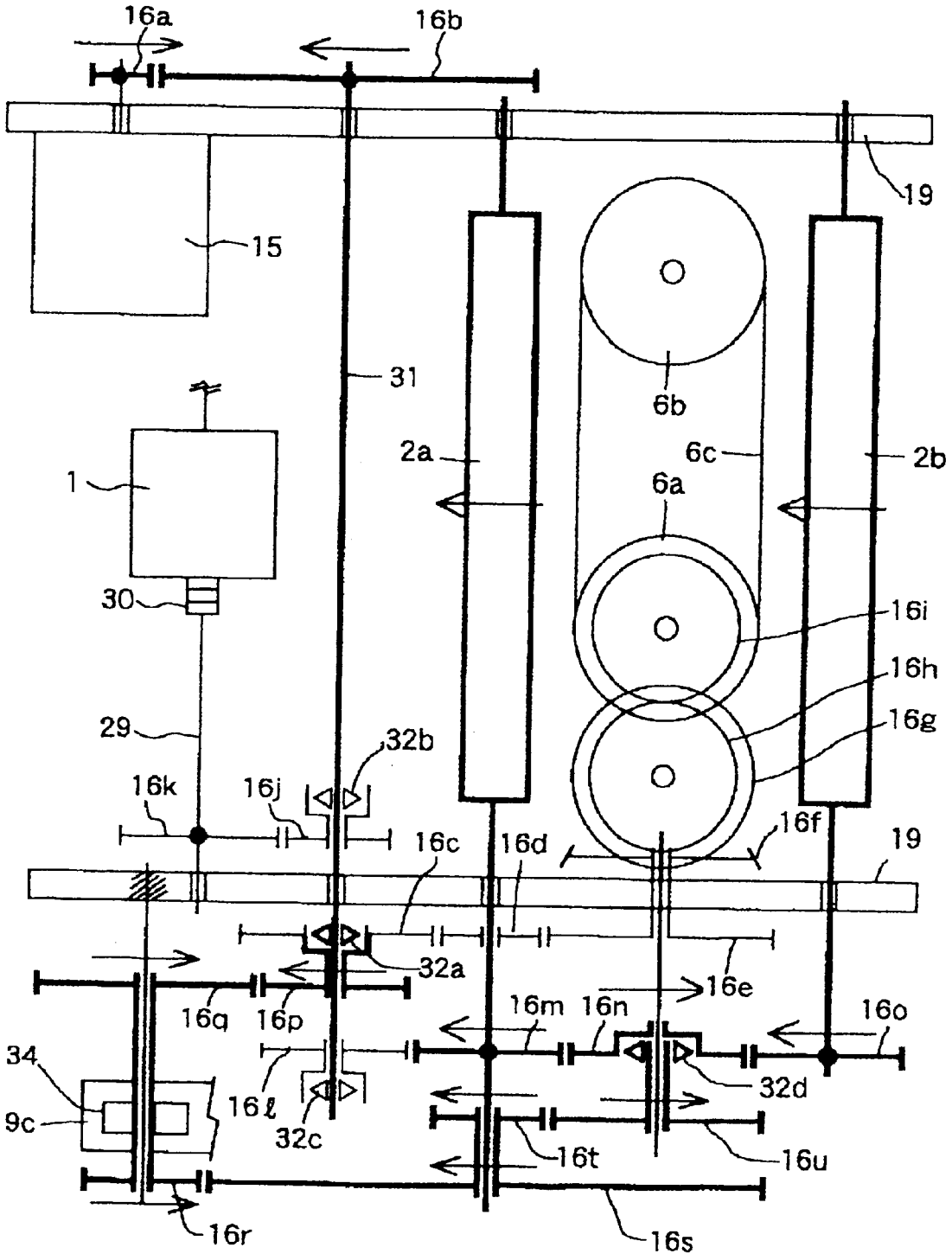
FIG. 10 is a conceptual diagram to illustrate the third driving force transmitting route of gear series employed by the embodiment as depicted in FIG. 1.

(III) Third Driving Force Transmitting Route (FIG. 10)

Immediately after the switch for printing out a selected image of the image processing device B has been turned on to expel print paper P, the motor 15 rotates again counterclockwise, and the rotating force is transmitted incessantly to the belt slinging mechanism 6 to put the carriage 5 into continuous back and forth movements until printing is completed.

The function performed by the gear series 16 in the transmission of the rotating force to the belt slinging mechanism 16 is the same as observed in relation to the first driving force transmitting route as described earlier in (I).

Here description will be given of the third driving force transmitting route of gear series 16 which works not only for transmitting incessantly the rotational force of the motor 15 to the belt slinging mechanism 6 but also for transmitting the same force to the pickup roll 1 and feed rolls 2*a* and 2*b* whenever the carriage 5 comes close to stroke ends and is going to make U turns As shown in FIG. 10, the gear series 16 transmits the rotation of motor 15 via gears 16*a* and 16*b* meshing with each other to a shaft 31; the rotation of axis 31 is further transmitted via a one-way clutch 32*a* to a gear 16*p* (teeth number 12), and also via a gear 16*p* and a gear 16*g* (teeth number 30) meshing with each other to a Genova gear 16*r* (tooth numbers one); here continuous rotations are converted into discontinuous rotations through the discontinuous engagement of Genova gear 16*r* with a gear 16*s* (teeth number 18); the discontinuous rotation is then transmitted to a gear 16*t* (teeth number 12) integratively united with a gear 16*t*; the same rotation is further transmitted via a gear 16*t* and a gear 16*u* (teeth number 38) meshing with each other and then via a one-way clutch 32*d* inserted between the shaft of a gear 16*u* and the axial hole of a gear 16*n* to the gear 16*n*; and the same discontinuous rotation is further transmitted via gears 16*n*, 16*m* and 16*o* meshing each other to feed rolls 2*a* and 2*b* integratively united with a gear 16*n* or a gear 16*o*. Through this route, each time the carriage comes to a stroke end and makes a U turn there, the feed rolls 2*a* and 2*b* rotates by a very tiny angle thereby advancing print paper P by about 0.15 mm.

Turn to FIGS. 1 and 2 for illustration. The gear series 16 contains a pair of bevel gears 16*f* and 16*g* meshing with each other one acting a driving part and the other acting a subject part at a place where a driving force transmitting route for transmitting the rotatory force to the belt slinging mechanism 5 bifurcates. The subject bevel gear 16*g* may be fitted immovable to an axis sharing the same axis with that of driving timing pulley 6*a*, but the driving bevel gear 16*f* may not be firmly fitted to the same axis, because other gears are located too close. To meet this situation, a bracket 33 for preventing the bevel gear displacement and erected on chassis 19 is placed in contact with the rear surface of driving bevel gear 16*f*, to prevent thereby the driving bevel gear 16 from slipping off the axis in the presence of a counter force which may arise when the driving bevel gear 16*f* transmits the rotation to the subject bevel gear 16*g*.

Next, the operation will be described.

With the printing device A, when a power switch (not illustrated here) is turned on, the motor 15 is put into counterclockwise rotations; the rotation of motor 15 is transmitted via the first driving force transmitting route of gear series 16 to the belt slinging mechanism 6; the carriage 5 makes therewith approximately one forward and backward movement; the carriage 5 returns to an original position dependent on the sensing by the sensors 21*a* and 21*b*; the motor 15 stops rotating; the bar-code sensor reads a bar-code C3 attached to the cassette C to identify the kind of print paper P contained in the cassette C; and according to the kind of print paper P the intensity and duration of light to be emitted by LED's 8*a*, 8*b* and 8*c* are adjusted.

Then, when a switch for printing out an image from the image processing device B is turned on, the motor 15 is put into clockwise rotations; the rotation of motor 15 is transmitted via the second driving force transmitting route of gear series 16 to pickup roll 1 and feed rolls 2*a* and 2*b*; pickup roll 1 pushes out print paper P bit by bit from cassette C to insert the latter between feed roll 2*a* and pinch roll 3*a*; and when a paper sensor 24 detects the front end of print paper P, the motor 15 stops rotating.

Immediately thereafter, the motor 15 starts to make counterclockwise rotations; the rotation of motor 15 is transmitted via the first driving force transmitting route of gear series 16 to the belt slinging mechanism 6; the carriage 5 starts to make back and forth movements; and at the same time the rotation of motor 15 is transmitted via the third driving force transmitting route of gear series 16 to pickup roll 1 and feed rolls 2*a* and 2*b*.

When the circulating pin 25 moves straight from an original position a to position b through this operation, or when it moves straight from position c to position d, LED's 8*a*, 8*b* and 8*c* give blinking light onto print paper P in accordance with image data supplied from the image processing device B, thereby rendering micro-capsules which have been exposed to light with a specific wavelength refractory to pressure.

While the circulating pin 25 is making a U turn from position b to position c, or position d to original position a, the cam 24 presses down the cam follower 9*c* by a tiny distance, and feed rolls 2*a* and 2*b* advance print paper by about 0.15 mm.

Later, when the circulating pin 25 moves straight from original position a to position b, or from position c to position d, the cam 24 relieves the cam follower 9*c* of the pressed-down state, thereby releasing a force from the spring 28 which raises the platen 9; the revolving roll 12*a* applies a pressure on print paper P as effectively as if it drew a line thereupon, thereby selectively crushing by pressure micro-capsules which have never been exposed to light with a specific wavelength and thus never hardened; and repeating this operation results in selective crushing of unreacted micro-capsules over the whole surface of print paper P.

When the platen P is raised, a load imposed on the revolving roll 12*a* is transmitted as a moment to the carriage 5. However, because the planar spring 10 absorbs irregular fluctuations of the carriage 5, the sensors 21*a* and 21*b* mounted on the carriage 5 can read divisions on the scale 23 accurately without missing any, thereby ensuring the proper blinking operation of LED's 8*a,* 8*b* and 8*c* and preventing the image from developing a fringe or a stripe pattern.

The heater 14, when print paper P passes through a gap between the heater 14 and the planar spring 13; comes into contact with the coloring substance whose micro-capsules have been crushed by pressure and which thus have contacted with the image receiving layer, heats the coloring substance, helps the latter develop a color instantly, and reproduce an image.

The first embodiment described above is so constructed as to instantly correct the running position of carriage even when an error related with the reading by a sensor of a division on the linear encoder occurs, and can be applied not only to an ink-jet printing device but also to a thermal printing device and a thermal sublimation printing device. Further, this invention is not limited to a printing device in which a carriage makes back and forth movements being guided by a carriage guide.

Figure 11:
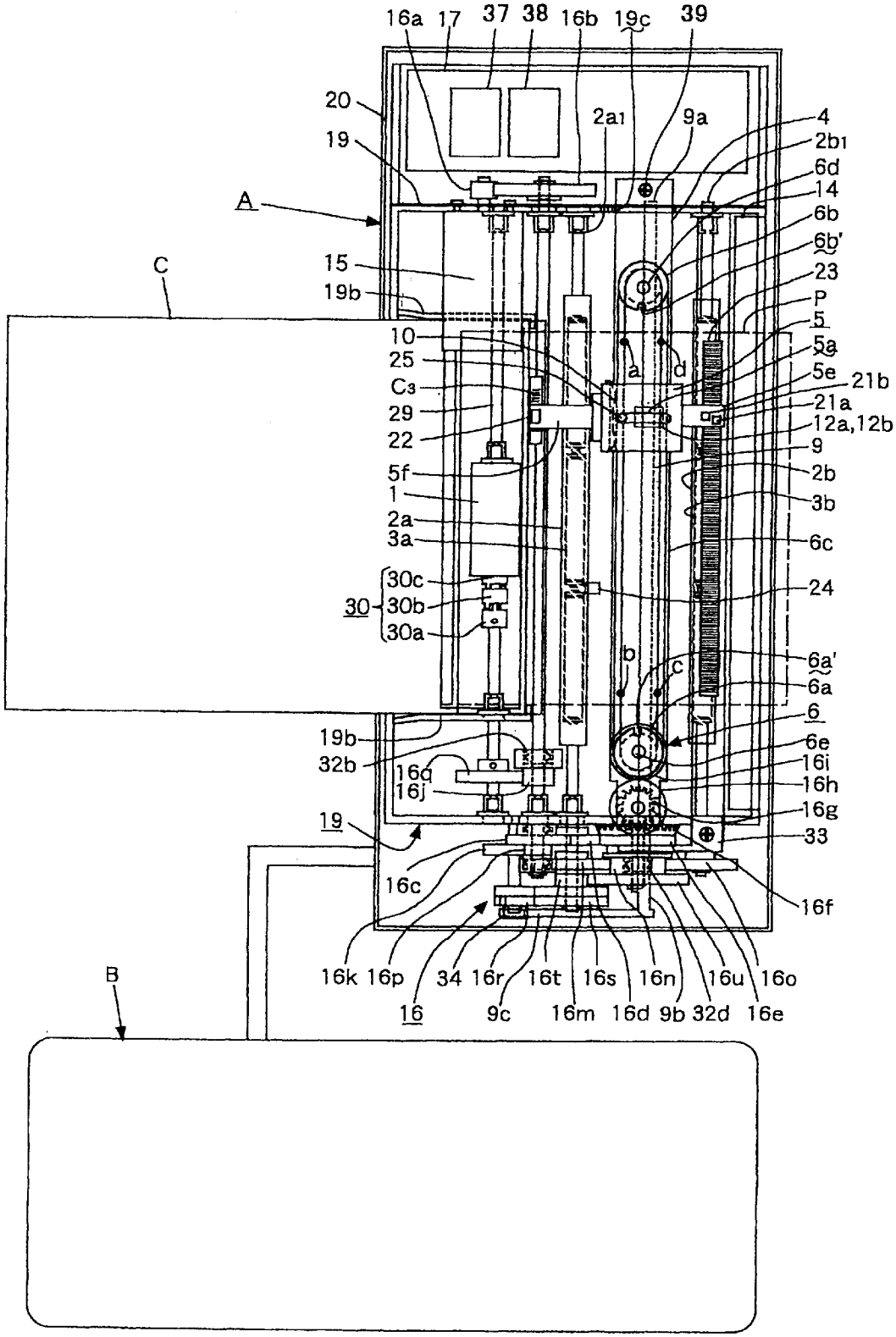
FIG. 11 is a flat view of a system representing a second embodiment of this invention depicted as large as the real object, and comprising a printing device and an image processing device.

FIG. 11 is a diagram to illustrate a second embodiment of this invention, is drawn so as to correspond with that of FIG. 1, and attaches the same symbols to the corresponding parts. The difference between the first and second embodiments is that, in contrast with the first embodiment which has the running position memorizing circuit 35 and error detection/correction circuit 36, the second embodiment has a running position memorizing device 37 and running direction determining device 38.

The different points will be mainly described below, but explanation of other components will be omitted because they are the same in function with those described above (FIG. 2 or 6, and FIG. 8 or 10).

Figure 12:
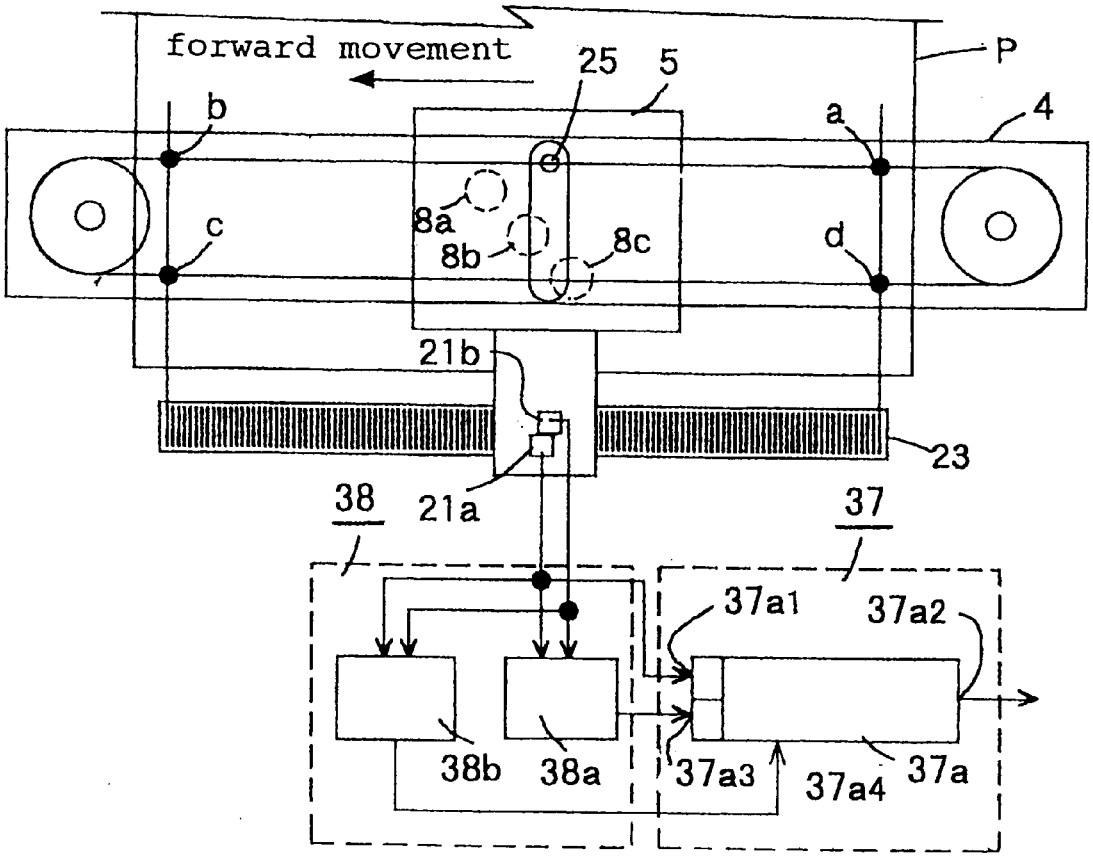
FIG. 12 is a conceptual diagram to illustrate relationships between the carriage, two sensors, linear encoder, running position memorizing device, running direction determining device and head of the embodiment as depicted in FIG. 11.

FIG. 12 is a diagram to illustrate characteristic parts of the second embodiment, that is, a conceptual diagram to illustrate the relationships between a carriage, two sensors, a linear encoder, running position memorizing device and running direction determining device.

Firstly, the second embodiment will be outlined. The second embodiment is so constituted as to perform a following initialization adjustment: in FIG. 11, when an on-signal is fed to a power switch of a printing device A, a controller 17 delivers a motor driving signal to put a motor 15 into counterclockwise rotations; sensors 21*a* and 21*b* mounted on a carriage 5 which makes back and forth movements being driven by the motor, deliver signals informing reading of divisions on a scale 23 to a running position memorizing device 37; the position of carriage 5 is determined by calculation; a running direction determining device 38 which determines the running direction of carriage 5 each time the carriage 5 makes one forward and backward movement, delivers a signal, regardless of whether the sensor 21*a* properly reads divisions on the scale 23 or errs in reading them; dependent on that signal the running position memorizing device 37 makes a correction by presetting the running position of carriage 5 to a specified position; when a circulating pin 25 connecting a timing belt 6*c* and the carriage 5 comes to a point somewhat inside the lateral margin of printable area of print paper P, for example, to an original position located 5 mm inside the lateral margin, delivery of driving signals from the motor is arrested; and while the carriage 5 is being properly placed on the original position, a bar-code sensor 22 reads a bar-code attached to a cassette C, a signal therefrom informing the reading is processed to identify the kind of print paper contained in the cassette C, and a program to set the intensity and duration of light to be emitted from LED's 8*a,* 8*b* and 8*c* appropriately according to the kind of print paper in extracted from ROM.

Next, the operation of second embodiment will be detailed below with reference to FIG. 12.

The running position memorizing device 37 comprises an up-down counter circuit 37*a,* while the running direction determining device 38 comprises a count direction switching signal generating circuit 38*a* and a reset signal generating circuit 38*b*.

The up-down counter circuit 37*a* is so constituted as to perform a following operation: it has an input terminal for count signals, an output terminal 37*a*2 for count signals, another input terminal 37*a*3 for count switching signals, and a further input terminal 37*a*4 for reset signals; and when the circuit receives a sensor signal from the sensor 21 fed via a wave-form rectifying circuit not illustrated here to the input terminal 37*a*1 for count signals, it proceeds a counting-up or counting-down, and at the same time delivers the same signal as output from the output terminal 37*a*2 for count signals. The same circuit is so constituted as to prepare a following counting state when an incoming signal entering through the input terminal 37*a*3 for counting-mode switching signals takes unit, counting-up proceeds, and when the same incoming signal takes null, counting-down proceeds.

The counting-mode switching signal generating circuit 38*a* is so constituted as to perform a following operation: it receives sensor signals from two sensors 21*a* and 21*b;* it determines as shown in FIG. 5 that the carriage 5 makes a forward movement when it finds a rectangular signal Pa1 remains 0 while a rectangular wave signal Pb1 changes from 1 to 0, and determines as shown in FIG. 6 that the carriage 5 makes a backward movement when it finds a rectangular wave signal Pa2 remains 1 when a rectangular wave signal Pb2 changes from 1 to 0; and, when it finds the carriage is in forward movement, it delivers an instruction signal for counting-up (for example signal conveying 1) to the input terminal 37*a*3 for counting-mode switching signals of up-down counter circuit 37*a,* while when it finds the carriage is in backward movement, it delivers an instruction signal for counting-down (for example signal conveying 0) to the same input terminal.

A reset signal generating circuit 38*b* is so constituted as to perform a following operation: it receives a signal from the counting-mode switching circuit 38*a* in a separate but parallel manner as does the up-down counter circuit 37*a* which receives the same signal; when the instruction conveyed by the output signal from the counting-mode switching circuit 38*a* changes from counting-down to counting-up, the circuit in question delivers a reset signal; and that reset signal is fed to the input terminal 37*a*4 for reset signals of up-down counter circuit 37*a*.

When the carriage 5 turns from a backward movement to a forward movement, and first sensor signals are delivered by sensors 21*a* and 21*b*, a counting-up instruction signal from the counting-mode switching signal generating circuit 38*a* is fed to the input terminal 37*a*3 for counting-mode switching signals of up-down counter circuit 37*a*, and at the same time a reset signal from the reset signal generating circuit 38*b* is fed to the input terminal 37*a*4 for reset signals of up-down counter circuit 37*a*, thereby resetting the value counted up to that time to null; and then while the carriage 5 is making a forward movement, sensor signals from the sensor 21*a* are fed to the input terminal 37*a*1 for count signals of up-down counter circuit 37*a* to maintain counting-up, and at the same time the same incoming signals are delivered as output from the output terminal 37*a*2 for count signals of up-down-counter circuit 37*a*.

When the carriage turns from a forward movement to a backward movement, and first sensor signals from sensors 21*a* and 21*b* are delivered, a counting-down instruction signal from the counting-mode switching signal generating circuit 38*a* is fed to the input terminal 37*a*3 for counting-mode switching signals of up-down counter circuit 37*a*, and later on while the carriage 5 is making a backward movement, sensor signals from the sensor 21*a* are fed to the input terminal 37*a*1 for count signals of up-down counter circuit 37*a* to maintain counting-down, and at the same time the same incoming signals are delivered as output from the output terminal 37*a*2 for count signals of up-down counter circuit 37*a*.

Although the carriage 5 may pans through an unstable position or undergo a chattering each time it comes to a stroke end, the running position memorizing device 37 allows stable entry of sensor signals from the sensors 21*a* and 21*b*, because both ends of divisions across the linear encoder 23 are located at positions sufficiently well apart from and inside the stroke ends of carriage 5.

The controller 17 is so constituted as to perform a following operation: it receives signals delivered via the output terminal 37*a*2 for count signals by the up-down counter circuit 37*a*, processes them to produce head driving synchronous signals or electric signals to blink LED's 8*a*, 8*b* and 8*c*. and sends the thus derived electric signals to blink LED's 8*a*, 8*b* and 8*c* to LED's 8*a*, 8*b* and 8*c*.

As seen from above, even if the sensors 21*a* and 21*b* miss reading a division on the linear encoder 23, and owing to this miss, an error in the detection of ruining position of carriage 5 results, that error is readily checked before the carriage makes one forward and backward movement so that such errors do not accumulate, and thus no fringe of any one image will extend to overall images reproduced on print paper.

As described above, with the second embodiment, even if the carriage becomes unstable in its movement on approaching stroke ends, no adverse effects will arise in the delivery of carriage position detecting signals, and further even if the sensor misses reading a division on the linear encoder, the running position of carriage is corrected each time the carriage comes to an initial position, and the embodiment can be applied not only to an ink-jet printing device but also to a thermal or thermal sublimation printing device.

According to this invention, even if the sensor misses reading a division on the linear encoder, and an error occurs in the detection of the running position of carriage, it is possible to instantly correct that error thereby preventing the development of fringe on an image reproduced on print paper P.

According to another aspect of this invention, even if the carriage becomes unstable in its movement on approaching stroke ends, no adverse effect arises in the delivery of carriage position detecting signals, and even if the sensor misses reading a division on the linear encoder thereby causing an error in the determination of the running position of the carriage, that error in checked before the carriage makes a forward and backward movement, and thus development of a fringe on any one image on print paper P is prevented from extending to overall images, and hence fringes affecting overall images are effectively eliminated.

What is claimed is:

1. A printing device comprising: a print head for printing an image on an image recording medium; a carriage mounted for movement along the image recording medium and supporting thereon the print head; a carriage guide for guiding the carriage during movement thereof; a motor for drivingly moving the carriage; a linear encoder having a plurality of division lines; a sensor supported by the carriage for movement therewith and for reading the division lines of the linear encoder to detect a running position of the carriage; a running position memorizing device for receiving pulse signals from the sensor corresponding to the division lines read and for calculating a running position of the carriage in accordance with the sensor pulse signals; and an error detection/correction circuit for receiving the pulse signals from the sensor, detecting a reading error by the sensor corresponding to an error in the detection of the running position of the carriage, and outputting an error correction signal to the running position memorizing device; wherein the running position memorizing device calculates a correct running position of the carriage in accordance with the error correction signal from the error detection/correction circuit, and the print head prints an image on the image recording medium in accordance with an output from the running position memorizing device.

2. A printing device as claimed in claim 1; wherein the error detection/correction circuit comprises a pulse counter circuit for generating a count value by counting clock pulses at each interval between successive sensor pulse signals outputted to the running position memorizing device, and a correction circuit for detecting the reading error by the sensor by comparing the count value generated by the pulse counter circuit with a reference pulse count and, when the reading error is detected, outputting the error correction signal for correcting the running position of the carriage.

3. A printing device as claimed in claim 1; wherein the running position memorizing device comprises a counter for counting the signals outputted by the sensor.

4. A printing device comprising: a print head for printing an image on an image recording medium; a carriage mounted for movement along the image recording medium and supporting thereon the print head; a carriage guide for guiding the carriage during movement thereof; a motor for drivingly moving the carriage forwardly and backwardly; a linear encoder having a plurality of division lines; a sensor supported by the carriage for movement therewith and for reading the division lines of the linear encoder to detect a running position of the carriage; a running direction determining device for determining a running direction of the carriage; a running position memorizing device for receiving pulse signals from the running position determining device corresponding to the running direction of the carriage, receiving pulse signals from the sensor corresponding to the division lines read, and calculating a running position of the carriage in accordance with the sensor pulse signals; and an error detection/correction circuit for receiving the pulse signals from the sensor, detecting a reading error by the sensor corresponding to an error in the detection of the running position of the carriage, and outputting an error correction signal to the running position memorizing device; wherein the running position memorizing device calculates a correct running position of the carriage in accordance with the error correction signal from the error/correction circuit, and the print head prints an image on the image recording medium in accordance with an output from the running position memorizing device.

5. A printing device as claimed in claim 4; wherein the running direction determining device comprises two sensors for outputting pulse signals having different phases for determining the running direction of the carriage.

6. A printing device as claimed in claim 4; wherein the running position memorizing device comprises an up-down counter which counts up pulses from the sensor while the carriage is making a forward movement, and counts down the same pulses while the carriage is making a backward movement.

7. A printing device comprising: a print head for printing an image on an image recording medium; a carriage mounted for movement along the image recording medium and supporting thereon the print head; a carriage guide for guiding the carriage during movement thereof; a motor for drivingly moving the carriage forwardly and backwardly between opposite stroke ends; a linear encoder having a plurality of division lines including two division lines disposed at opposite ends of the linear encoder and inside the stroke ends; a sensor supported by the carriage for forward and backward movement therewith between the stroke ends and for reading the division lines of the linear encoder to detect a running position of the carriage; a running direction determining device for determining a running direction of the carriage; and a running position memorizing device for receiving pulse signals from the sensor corresponding to the division lines read, calculating a running position of the carriage in accordance with the sensor pulse signals, storing the calculated running position of the carriage, and correcting the running position of the carriage by presetting the running position to a specified position in accordance with a running direction signal from the running direction determining device; wherein the print head prints an image on the image recording medium in accordance with an output from the running position memorizing device.

8. A printing device as claimed in claim 7; wherein the running direction determining device comprises two sensors for outputting pulse signals having different phases for determining the running direction of the carriage.

9. A printing device as claimed in claim 7; wherein the running position memorizing device comprises an up-down counter which, in response to a signal from the running direction determining device, counts up pulses from the sensor while the carriage is making a forward movement, and counts down the same pulses while the carriage is making a backward movement.

10. A printing device comprising: a body; a print head mounted on the body for movement in a scan direction for printing an image on print paper in accordance with image data; a linear encoder connected to the body; a position sensor mounted on the body for movement with the print head and for reading the linear encoder and generating position pulse signals corresponding to a position of the print head; a running position memorizing device for receiving the position pulse signals from the position sensor and converting the position pulse signals to driving synchronous signals; a pulse count correcting circuit for receiving clock pulse signals, receiving the position pulse signals from the position sensor, and counting the clock pulse signals during a detection-for-correction period in which a specific number of reference position pulse signals are received; and a correction-by-calculation circuit for receiving a count correction pulse from the pulse count correcting circuit, calculating a correction pulse count in accordance with the reference position pulse signals which are received during the detection-for-correction period, and outputting the correction pulse count to the running position memorizing device; wherein the print head prints an image on the print paper in accordance with the image data in response to the driving synchronous signals from the running position memorizing device.

11. A printing device as claimed in claim 10; wherein the print paper has a photosensitive type micro-capsule coating, and the print head has a light emitting element for radiating light corresponding to image data on the print paper to thereby produce a latent image on the print paper; further comprising pressurizing means for applying mechanical pressure on the print paper carrying the latent image to thereby develop the image.

12. A system comprising: an image processing device for storing image data; and a printing device as claimed in claim 11 for printing an image on the print paper in accordance with the image data stored in the image processing device.

13. A system comprising: an image processing device for storing image data; and a printing device as claimed in claim 1 for printing an image on the image recording medium in accordance with the image data stored in the image processing device.

14. A system comprising: an image processing device for storing image data; and a printing device as claimed in claim 2 for printing an image on the image recording medium in accordance with the image data stored in the image processing device.

15. A system comprising: an image processing device for storing image data; and a printing device as claimed in claim 3 for printing an image on the image recording medium in accordance with the image data stored in the image processing device.

16. A system comprising: an image processing device for storing image data; and a printing device as claimed in claim 4 for printing an image on the image recording medium in accordance with the image data stored in the image processing device.

17. A system comprising: an image processing device for storing image data; and a printing device as claimed in claim 5 for printing an image on the image recording medium in accordance with the image data stored in the image processing device.

18. A system comprising: an image processing device for storing image data; and a printing device as claimed in claim 6 for printing an image on the image recording medium in accordance with the image data stored in the image processing device.

19. A system comprising: an image processing device for storing image data; and a printing device as claimed in claim 7 for printing an image on the image recording medium in accordance with the image data stored in the image processing device.

20. A system comprising: an image processing device for storing image data; and a printing device as claimed in claim 8 for printing an image on the image recording medium in accordance with the image data stored in the image processing device.

21. A system comprising: an image processing device for storing image data; and a printing device as claimed in claim 9 for printing an image on the image recording medium in accordance with the image data stored in the image processing device.

22. A system comprising: an image processing device for storing image data; and a printing device as claimed in claim 9 for printing an image on the image recording medium in accordance with the image data stored in the image processing device.

23. A system comprising: an image processing device for storing image data; and a printing device as claimed in claim 10 for printing an image on the print paper in accordance with the image data stored in the image processing device.

24. A printing device comprising: printing means having a print head for printing an image on an image recording medium; a carriage mounted for movement along the image recording medium and supporting thereon the print head; carriage drive means for drivingly moving the carriage; an encoder member having a plurality of division lines; detecting means supported by the carriage for movement therewith for reading the division lines of the encoder member and outputting pulse signals corresponding to reading of the division lines; position calculating means for calculating a position of the carriage in accordance with the pulse signals from the detecting means; and error detection/correction means for detecting an error in reading the division lines of the encoder member by the detecting means and for outputting an error correction signal to the position calculating means; wherein the position calculating means calculates a correct position of the carriage in accordance with the error correction signal from the error detection/correction means, and the print head prints an image on the image recording medium in accordance with an output signal from the position calculating means corresponding to the correct position of the carriage.

25. A printing device as claimed in claim 24; wherein the error detection/correction means comprises a first circuit for generating a count value by counting clock pulses at each interval between successive pulse signals from the detecting means, and a second circuit for detecting the reading error by the detecting means by comparing the count value generated by the first circuit with a reference pulse count and outputting the error correction signal for calculating the correct position of the carriage.

26. A system comprising: an image processing device for storing image data; and a printing device as claimed in claim 25 for printing an image on the image recording medium in accordance with the image data stored in the image processing device.

27. A printing device as claimed in claim 24; wherein the detecting means comprises a pair of sensors attached to a surface of the carriage in confronting relation to the encoder member, the sensors being spaced-apart from each other by a distance half as long as a width of one the division lines of the encoder member.

28. A printing device as claimed in claim 24; wherein the position calculating means comprises a counter for counting the pulse signals from the detecting means.

29. A system comprising: an image processing device for storing image data; and a printing device as claimed in claim 24 for printing an image on the image recording medium in accordance with the image data stored in the image processing device.

30. A printing device comprising: printing means having a print head for printing an image on an image recording medium; a carriage supporting thereon the print head and mounted for reciprocal movement in forward and rearward directions between opposite stroke ends of the carriage and along the image recording medium; carriage drive means for drivingly moving the carriage; a linear encoder member having a plurality of division lines including two end division lines disposed at opposite ends of the linear encoder, the two end division lines being spaced apart from and disposed between the stroke ends of the carriage; a sensor supported by the carriage for movement therewith for reading the division lines of the encoder member and outputting pulse signals corresponding to reading of the division lines; first circuit means for determining whether the carriage is moving in the forward or the rearward direction; and second circuit means for calculating a position of the carriage in accordance with the pulse signals from the sensor, detecting an error in reading the division lines of the linear encoder member by the sensor, and correcting the position of the carriage in accordance with a signal from the first circuit means corresponding to the moving direction of the carriage by presetting the position of the carriage to a predetermined position; wherein the print head prints an image on the image recording medium in accordance with an output signal from the second circuit means corresponding to the corrected position of the carriage.

31. A printing device as claimed in claim 30; wherein the first circuit means comprises two sensors for outputting pulse signals having different phases for determining the moving direction of the carriage.

32. A printing device as claimed in claim 30; wherein the second circuit means comprises a counter circuit for incrementing a pulse count value of the sensor pulse signals when the carriage is moving in the forward direction, and for decrementing the pulse count value of the sensor pulse signals when the carriage is moving in the rearward direction.

33. A printing device as claimed in claim 32; wherein the first circuit means comprises reset means for resetting the counter circuit when the carriage switches from movement in the rearward direction to movement in the forward direction.

34. A printing device as claimed in claim 30; wherein the second circuit means comprises a counter circuit for incrementing a pulse count value of the sensor pulse signals when the carriage is moving in the forward direction, and for decrementing the pulse count value of the sensor pulse signals when the carriage is moving in the rearward direction; and wherein the first circuit means comprises a switching signal generating circuit for determining whether the carriage is moving in the forward direction or the rearward direction on the basis of the sensor pulse signals, outputting an instruction signal to the counter circuit to increment the pulse count value when it is detected that the carriage is moving in a forward direction, and outputting an instruction signal to the counter circuit to decrement the pulse count value when it is detected that the carriage is moving in a rearward direction.

35. A printing device as claimed in claim 34; wherein the first circuit means further comprises a reset signal generating circuit for outputting a reset signal to the counter circuit to reset the counter signal in response to an instruction signal from the switching signal generating circuit outputted when the carriage switches from movement in the rearward direction to movement in the forward direction.

36. A system comprising: an image processing device for storing image data; and a printing device as claimed in claim 34 for printing an image on the image recording medium in accordance with the image data stored in the image processing device.

* * * * *